US010646755B1

(12) United States Patent
Kleinert et al.

(10) Patent No.: US 10,646,755 B1
(45) **Date of Patent: *May 12, 2020**

(54) GOLF CLUB HEAD

(71) Applicant: TAYLOR MADE GOLF COMPANY, INC., Carlsbad, CA (US)

(72) Inventors: Justin David Kleinert, San Clemente, CA (US); Mattieu J. Bovee, Carlsbad, CA (US); Joseph Reeve Nielson, Vista, CA (US); Nathan T. Sargent, Oceanside, CA (US); Christopher John Harbert, Carlsbad, CA (US); Rachel Elizabeth Gardner, Vista, CA (US); Wester Reber Christian, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,477

(22) Filed: Dec. 20, 2017

Related U.S. Application Data

(63) Continuation of application No. 15/233,805, filed on Aug. 10, 2016, now Pat. No. 9,868,036, which is a continuation-in-part of application No. 15/087,002, filed on Mar. 31, 2016, now Pat. No. 9,914,027.

(60) Provisional application No. 62/205,601, filed on Aug. 14, 2015.

(51) Int. Cl.
*A63B 53/04* (2015.01)
*A63B 53/06* (2015.01)

(52) U.S. Cl.
CPC ..... *A63B 53/0466* (2013.01); *A63B 53/06* (2013.01); *A63B 2053/045* (2013.01); *A63B 2053/0433* (2013.01); *A63B 2053/0437* (2013.01); *A63B 2053/0491* (2013.01); *A63B 2053/0495* (2013.01)

(58) Field of Classification Search
CPC ..... A63B 53/0466; A63B 53/06; A63B 2053/0433; A63B 2053/0495; A63B 2053/0437; A63B 2053/045; A63B 2053/0491
USPC ..... 473/324–350, 287–292
See application file for complete search history.

(56) References Cited

U.S. PATENT DOCUMENTS 4,895,371 A * 1/1990 Bushner ..... A63B 60/02 473/336
6,364,789 B1 4/2002 Kosmatka
6,525,157 B2 2/2003 Cozewith et al.
6,672,975 B1 1/2004 Galloway
6,773,360 B2 8/2004 Willett et al.
6,800,038 B2 10/2004 Willett et al.
6,824,475 B2 11/2004 Burnett et al.
6,878,078 B2 4/2005 Swanson
6,945,876 B2 * 9/2005 Nakahara ..... A63B 53/0466 473/329
6,955,612 B2 10/2005 Lu
(Continued)

*Primary Examiner* — Sebastiano Passaniti
(74) *Attorney, Agent, or Firm* — Duane Morris LLP

(57) ABSTRACT

A golf club head is disclosed having a main body comprising a face portion, a top portion, a bottom portion opposite the top portion, a toe portion and a heel portion opposite the toe portion. The golf club head includes one or more slideably adjustable weights within one or more weight tracks and/or one or more interchangeable weights within one or more weight ports, the weights provided so as to adjust a center of gravity (CG) of the golf club head.

20 Claims, 34 Drawing Sheets

(56) References Cited

U.S. PATENT DOCUMENTS 6,964,617 B2 11/2005 Williams
6,997,820 B2 2/2006 Willett et al.
7,094,159 B2 8/2006 Takeda
7,140,974 B2 11/2006 Chao et al.
7,166,040 B2 1/2007 Hoffman et al.
7,166,041 B2 * 1/2007 Evans ..... A63B 53/0466 473/334
7,186,190 B1 3/2007 Beach et al.
7,214,142 B2 5/2007 Meyer
7,223,180 B2 5/2007 Willett et al.
7,226,366 B2 6/2007 Galloway
7,267,620 B2 9/2007 Chao et al.
7,297,072 B2 11/2007 Meyer
7,367,900 B2 5/2008 Kumamoto
7,407,447 B2 8/2008 Beach et al.
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,530,903 B2 * 5/2009 Imamoto ..... A63B 53/0466 473/335
7,530,904 B2 5/2009 Beach et al.
7,540,811 B2 6/2009 Beach et al.
7,553,242 B2 6/2009 Meyer
7,568,985 B2 8/2009 Beach et al.
7,572,193 B2 * 8/2009 Yokota ..... A63B 53/0466 473/328
7,578,753 B2 8/2009 Beach et al.
7,591,738 B2 9/2009 Beach et al.
7,611,424 B2 * 11/2009 Nagai ..... A63B 53/0466 473/334
7,621,823 B2 11/2009 Beach et al.
7,628,707 B2 12/2009 Beach et al.
7,628,712 B2 12/2009 Chao et al.
7,632,194 B2 12/2009 Beach et al.
7,691,008 B2 * 4/2010 Oyama ..... A63B 53/0466 473/345
7,713,142 B2 5/2010 Hoffman et al.
7,717,804 B2 5/2010 Beach et al.
7,717,805 B2 5/2010 Beach et al.
7,731,603 B2 * 6/2010 Beach ..... A63B 53/0466 473/335
7,744,484 B1 6/2010 Chao et al.
7,775,905 B2 8/2010 Beach et al.
7,806,782 B2 * 10/2010 Stites ..... A63B 53/0466 473/334
7,846,041 B2 12/2010 Beach et al.
7,850,544 B2 12/2010 Meyer
7,874,936 B2 1/2011 Chao et al.
7,874,937 B2 1/2011 Chao et al.
7,874,938 B2 1/2011 Chao et al.
7,963,861 B2 6/2011 Beach et al.
RE42,544 E 7/2011 Chao et al.
7,985,146 B2 7/2011 Lin et al.
7,993,216 B2 * 8/2011 Lee ..... A63B 53/0466 473/334
8,025,587 B2 9/2011 Beach et al.
8,096,897 B2 1/2012 Beach et al.
8,147,354 B2 4/2012 Hartwell
8,235,831 B2 8/2012 Beach et al.
8,303,431 B2 11/2012 Beach et al.
8,337,319 B2 12/2012 Sargent et al.
8,353,786 B2 1/2013 Beach et al.
8,444,505 B2 5/2013 Beach et al.
8,628,434 B2 1/2014 Chao et al.
8,721,472 B2 * 5/2014 Kuan ..... A63B 53/0487 473/341
8,734,271 B2 5/2014 Beach et al.
8,870,678 B2 10/2014 Beach et al.
8,888,607 B2 11/2014 Harbert et al.
8,894,506 B1 * 11/2014 Myers ..... A63B 53/0466 473/334
9,033,821 B2 5/2015 Beach et al.
9,174,096 B2 11/2015 Sargent et al.
9,238,162 B2 * 1/2016 Breier ..... A63B 53/0466
9,259,625 B2 2/2016 Sargent et al.
9,278,262 B2 3/2016 Sargent et al.
9,387,376 B1 * 7/2016 Hall ..... A63B 53/06
9,440,126 B2 * 9/2016 Boyd ..... A63B 53/0466
9,504,889 B2 11/2016 Mitzel
9,561,413 B2 2/2017 Nielson et al.
9,597,563 B2 * 3/2017 Voshall ..... A63B 53/06
9,636,556 B2 * 5/2017 Beck ..... A63B 53/00
9,682,298 B1 * 6/2017 Kingston ..... A63B 53/0466
9,724,577 B1 * 8/2017 Kingston ..... A63B 53/06
9,914,027 B1 * 3/2018 Harbert ..... A63B 53/0466
2005/0020379 A1 1/2005 Kumamoto
2005/0266933 A1 12/2005 Galloway
2006/0122004 A1 * 6/2006 Chen ..... A63B 53/0466 473/335
2006/0287129 A1 12/2006 Billings
2006/0293118 A1 12/2006 Meyer
2008/0149267 A1 6/2008 Chao
2008/0261715 A1 * 10/2008 Carter ..... A63B 53/0466 473/291
2009/0163289 A1 6/2009 Chao
2010/0075773 A1 * 3/2010 Casati, Jr. ..... A63B 49/02 473/334
2011/0152000 A1 6/2011 Sargent et al.
2011/0312437 A1 12/2011 Sargent et al.
2012/0071264 A1 3/2012 Beach et al.
2012/0122601 A1 5/2012 Beach et al.
2012/0129621 A1 5/2012 Boyd
2012/0258818 A1 10/2012 Beach et al.
2013/0123040 A1 5/2013 Willett et al.
2013/0137533 A1 5/2013 Franklin
2014/0080628 A1 * 3/2014 Sargent ..... A63B 53/0466 473/336
2015/0297961 A1 * 10/2015 Voshall ..... A63B 53/06 473/335
2015/0306473 A1 * 10/2015 Breier ..... A63B 53/0466 473/336
2016/0001146 A1 1/2016 Sargent et al.
2016/0008687 A1 1/2016 Sargent et al.
2016/0136490 A1 5/2016 Sargent et al.
2016/0271464 A1 * 9/2016 Murphy ..... A63B 53/0466
2016/0287954 A1 10/2016 Sargent et al.
2017/0072277 A1 3/2017 Mata et al.
2017/0087429 A1 3/2017 Nielson et al.

* cited by examiner

GOLF CLUB HEAD

CROSS REFERENCE TO RELATED APPLICATION

This application is a continuation of U.S. application Ser. No. 15/233,805, filed on Sep. 10, 2016, which claims the benefit of continuation-in-part application of U.S. application Ser. No. 15/087,002, filed on Mar. 31, 2016, which claims the benefit of U.S. Provisional Application No. 62/205,601, filed on Aug. 14, 2015, both of which applications are incorporated herein by reference in their entirety.

BACKGROUND

With the ever-increasing popularity and competitiveness of golf, substantial effort and resources are currently being expended to improve golf clubs. Much of the recent improvement activity has involved the combination of the use of new and increasingly more sophisticated materials in concert with advanced club-head engineering. For example, modem "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modem wood-type clubs are generally called "metalwoods" since they tend to be made of strong, lightweight metals, such as titanium.

An exemplary metalwood golf club such as a driver or fairway wood typically includes a hollow shaft having a lower end to which the club-head is attached. Most modern versions of these club-heads are made, at least in part, of a lightweight but strong metal such as titanium alloy. In most cases, the club-head comprises a body to which a face plate (used interchangeably herein with the terms "face" or "face insert" or "striking plate" or "strike plate") is attached or integrally formed. The strike plate defines a front surface or strike face that actually contacts the golf ball.

Some current approaches to reducing structural mass of a metalwood club-head are directed to making at least a portion of the club-head of an alternative material. Whereas the bodies and face plates of most current metalwoods are made of titanium alloy, several club-heads are available that are made, at least in part, of components formed from either graphite/epoxy-composite (or other suitable composite material) and a metal alloy. Graphite composites have a density of approximately 1.5 g/cm$^3$, compared to titanium alloy which has a density of 4.5 g/cm$^3$, which offers tantalizing prospects for providing more discretionary mass in the club-head.

The ability to utilize such materials to increase the discretionary mass available for placement at various points in the club-head allows for optimization of a number of physical properties of the club-head which can greatly impact the performance obtained by the user. Forgiveness on a golf shot is generally maximized by configuring the golf club head such that the center of gravity ("CG") of the golf club head is optimally located and the moment of inertia ("MOI") of the golf club head is maximized.

However, to date there have been relatively few golf club head constructions involving a polymeric material as an integral component of the design. Although such materials possess the requisite light weight to provide for significant weight savings, it is often difficult to utilize these materials in areas of the club head subject to stresses resulting from the high speed impact of the golf ball.

For example, some current metalwoods incorporate weight tracks in the sole to support slidable weights which allow the golfer to adjust the performance characteristics of the club by changing the weight position and effective center of gravity (CG) of the club head. The weight track is generally made from cast titanium to handle the high stress resulting from the high speed impact of the golf ball. Although titanium and titanium alloys are comparatively light in the context of other metals, titanium is still relatively heavy, requires a number of reinforcing ribs and produces undesirably low first modal frequencies (when the ball is struck). A heavier construction for the weight track and ribs means less discretionary weight is available for placement in strategic locations that benefit club performance.

Another recent trend in the industry is to make the club head out of strong, yet lightweight materials such as, for example, titanium, titanium alloys, steel alloys or a carbon fiber composite material. Of these materials, carbon fiber composites are particularly interesting to golf club designers because it has a density that is roughly one third of the density of titanium but is almost as strong as titanium.

Despite the strength and low density of carbon fiber composites, club heads that are made entirely of carbon fiber composites are generally not popular. This is due, in part, to the relatively high stiffness that is typical of carbon fiber composites. Moreover, carbon fiber composites are not particularly durable. Thus, composite club heads have a tendency to wear out in the areas that are subjected to large amounts of wear and friction (e.g., the sole of the club head).

To overcome the above-identified issues, a variety of multi-material metal-composite club heads have been developed. In one example, a metal-composite golf club head has a main metal body with a cast opening located on top of the metal body opposite the sole of the club head. The periphery of the opening includes an inner peripheral flange configured to mate with a peripheral edge of a top cover or "crown plate" or shell made of a composite material (e.g., carbon fiber or graphite). The crown plate is sized and shaped to fit within the top opening such that the peripheral edge of the crown plate mates with the inner peripheral flange of the opening along the entire periphery of the crown plate. In this way, the crown plate completely covers and seals the cast opening. During manufacturing, however, tolerance variations in the dimensions of the main metal body, the cast opening and/or the crown plate can cause the adjoining surfaces at the interface or joint between the crown plate and metal body to be uneven (i.e., not flush). Such fluctuations at these joints cause serious cosmetic defects that must be corrected, resulting in higher manufacturing times and costs and reduced yield of finished products.

When manufacturing conventional multi-material metal-composite club heads, in order to achieve a flush fit between the main body and the crown plate, one or both of the components (e.g., a top plate of the main body and/or the crown plate), is typically made thicker than necessary so that one or both components can be ground down to achieve a flush fit at the joint. Alternatively, or additionally, an extra amount of epoxy or other bonding material can be applied between adjoining surfaces at the joint between the mating components such that a significant amount of epoxy/bonding material will typically accumulate over the joint. This excess epoxy or bonding material, after it is cured, must then be ground down to achieve a flush surface at the joint, and thereafter painted to achieve a desired finished appearance. Needless to say, grinding down one or both components and/or grinding down excess epoxy increases the amount of time and labor necessary to manufacture a finished multi-material metal-composite club head.

In addition to the above problems associated with conventional multi-material metal-composite club heads, the above-described processes of grinding down extra component material and/or grinding down excess bonding material adds an undesired variability in the final weight of the club head, which can adversely affect the performance or "feel" of the club to a user. Furthermore, since any areas that must be ground down must be painted over to achieve a finished appearance, the amount of composite material surface area that remains visible to a user is significantly decreased. Additionally, even after grinding of excess material and/or bonding material is performed, as described above, if there is still a small amount of unevenness at the joint due to the top surface of the crown plate being slightly higher or lower than an adjacent top surface of the main body, the paint covering the joint will show a faint line where the unevenness exists. This faint line is referred to as "ghosting" and is undesirable because it imparts an aesthetic of "cheapness" or "poor design" to a user of the golf club.

In view of the above-described problems associated with conventional multi-material material golf club heads and their methods of manufacture, there is a need for improved golf club head designs and methods of manufacture that address one or more of the above-identified problems.

SUMMARY

In one embodiment, the golf club head may include a sole insert made of a material suitable to have a part injection molded thereto, and a thermoplastic composite head component overmolded on the sole insert to create a sole insert unit. The sole insert unit is joined to the frame and overlies the sole opening.

The composite head component overmolded on the sole insert may include one or more ribs to reinforce the head, one or more ribs to tune acoustic properties of the head, one or more weight ports to receive a fixed weight in a sole portion of the head, one or more weight tracks to receive one or more slidable weights, any combinations thereof, and other features.

The sole insert may be made from a thermoplastic composite material, thermoplastic carbon composite material, a continuous fiber thermoplastic composite material suitable for thermoforming, as well as other materials.

The weight track may be made from a thermoplastic composite material including a matrix compatible for binding with the sole insert material.

The golf club head may include a sole insert and weight track, each of which is made from a thermoplastic composite material having a compatible matrix to facilitate injection molding the weight track over the sole insert.

The sole insert and weight track each may be made from a thermoplastic carbon composite material having a compatible matrix selected from the group consisting of, for example, polyphenylene sulfide (PPS), nylon, polyamides, polypropylene, thermoplastic polyurethanes, thermoplastic polyureas, polyamide-amides (PAD, polyether amides (PEI), polyetheretherketones (PEEK), and any combination thereof.

The sole insert may also be made from a thermoset composite material suitable for thermosetting and coated with a heat activated adhesive to facilitate the weight track being injection molded over the sole insert.

The frame may be made from a metal material such as, for example, titanium, one or more titanium alloys, aluminum, one or more aluminum alloys, steel, one or more steel allows, and any combination thereof.

The sole and crown inserts may be made of a thermoplastic composite material including fibers such as, for example, glass fibers, aramide fibers, carbon fibers and any combination thereof, and include a thermoplastic matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof.

The sole insert and/or crown insert may be thermoformed from a continuous fiber composite material.

The golf club head may include a metal frame having a sole opening, a composite laminate crown insert joined to the frame, a composite laminate sole insert joined to the frame and overlying the sole opening, and a thermoplastic composite weight track overmolded on the sole insert.

A method of making the golf club head may include forming a frame having a sole opening, forming a composite laminate sole insert, injection molding a thermoplastic composite head component over the sole insert to create a sole insert unit, and joining the sole insert unit to the frame.

The sole and crown inserts may be formed by thermoforming using composite materials suitable for thermoforming.

The sole and/or crown inserts may be formed by thermosetting using materials suitable for thermosetting.

The thermoset sole and/or crown insert may be coated with a heat activated adhesive to facilitate injection molding a thermoplastic composite component over the sole and/or crown insert, such as one or more weight tracks, weight ports, ribs, supports or other features for strengthening, adding rigidity, acoustic tuning or other purposes. In a further embodiment, a golf club head includes; a main body comprising an opening and a recessed flange formed along at least a portion of a peripheral edge defining the opening; at least one compressible shim disposed on a top surface of the flange, the at least one compressible shim being compressible to at least 50% of its original uncompressed thickness; and a crown plate shaped and sized to fit within the opening, wherein a first portion of a bottom surface of the crown plate is affixed to the top surface of the flange and a second portion of the bottom surface is disposed on top of the at least one compressible shim, wherein the compressible shim is in a compressed state such that a top surface of the crown plate is flush with an adjacent top surface of the main body.

In another embodiment, a golf club head includes: a main body comprising an opening and a recessed flange formed along at least a portion of a peripheral edge defining the opening; at least one compressible shim disposed on a surface of the flange, the at least one compressible shim wherein the at least one compressible shim having a shim area that is 1% to 50% of an available area on the surface of the flange; and a cover plate shaped and sized to fit within the opening, wherein a first portion of a mating surface of the cover plate is affixed to the surface of the flange and a second portion of the mating surface is disposed on top of the at least one compressible shim, wherein the compressible shim is in a compressed state such that an outer surface of the cover plate is flush with an adjacent surface of the main body.

In another embodiment, a method for manufacturing a golf club head is disclosed. The method includes: providing a main body of the golf club head, the main body having an opening; attaching at least one compressible shim to a flange within the opening; placing a cover plate within the opening on top of the at least one compressible shim and the flange, wherein the cover plate covers the entirety of the opening; adjusting an amount of compression of the at least one compressible shim so that an outer surface of the cover plate is flush with an adjacent outer surface of the main body; and applying a bonding material between the cover plate and the flange so as to permanently affix the cover plate to the main body while the outer surface of the cover plate is flush with the adjacent outer surface of the main body.

The foregoing and other objects, features, and advantages of the invention will become more apparent from the following detailed description, which proceeds with reference to the accompanying figures.

DETAILED DESCRIPTION OF EXEMPLARY EMBODIMENTS

The following describes embodiments of golf club heads in the context of a driver-type golf club, but the principles, methods and designs described may be applicable in whole or in part to fairway woods, utility clubs (also known as hybrid clubs) and the like.

The following inventive features include all novel and non-obvious features disclosed herein both alone and in novel and non-obvious combinations with other elements. As used herein, the phrase "and/or" means "and," "or" and both "and" and "or." As used herein, the singular forms "a," "an" and "the" refer to one or more than one, unless the context clearly dictates otherwise. As used herein, the term "includes" means "comprises."

The following also makes reference to the accompanying drawings which form a part hereof. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down," "upper," "lower," "horizontal," "vertical," "left," "right" and the like. These terms are used where applicable, to provide some clarity of description when dealing with relative relationships, particularly with respect to the illustrated embodiments. Such terms are not, however, intended to imply absolute relationships, positions and/or orientations. For example, with respect to an object, an "upper" surface can become a "lower" surface simply by turning the object over. Nevertheless, it is still the same object. Accordingly, the following detailed description shall not be construed in a limiting sense and the scope of property rights sought shall be define by the appended claims and their equivalents.

Figure 1:
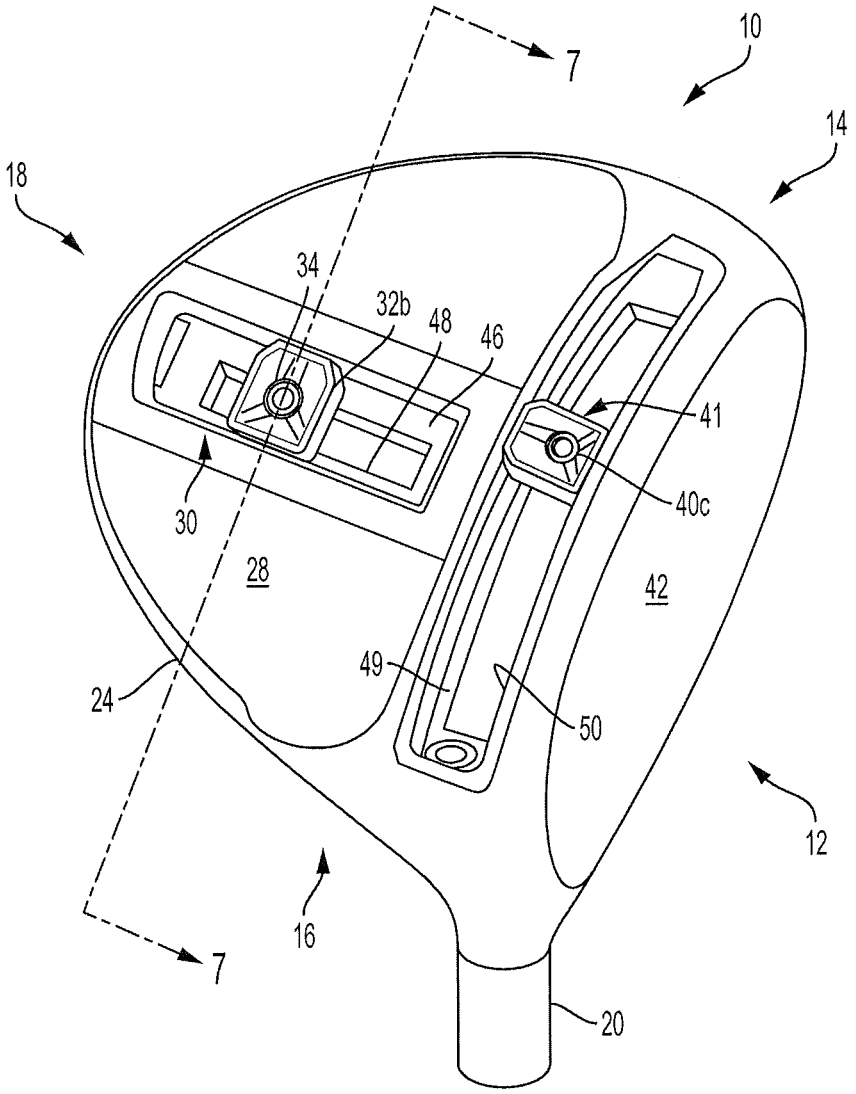
FIG. 1 is a bottom perspective view of a golf club head in accordance with one embodiment.
Figure 2:
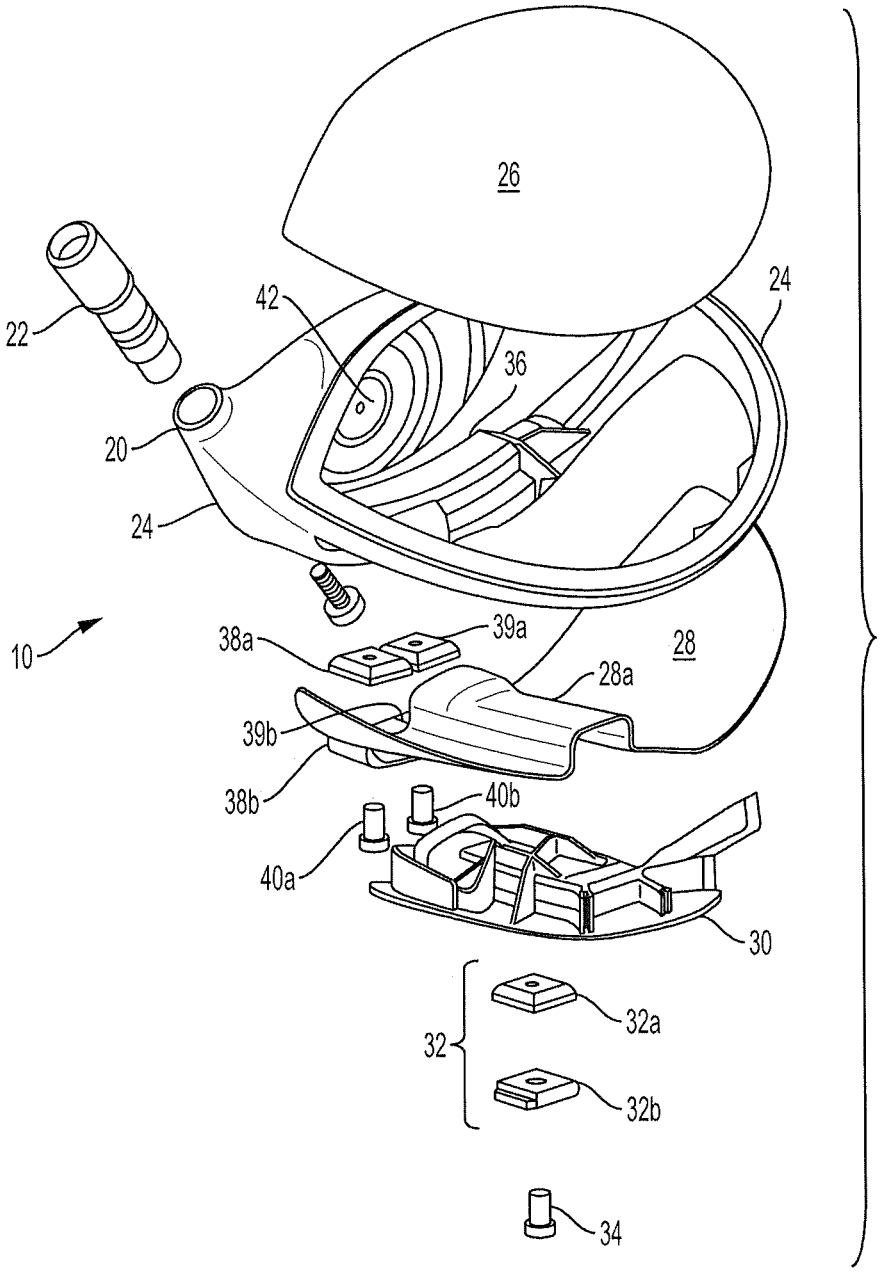
FIG. 2 is an exploded perspective view of the golf club head of FIG. 1 showing two slidable weights in a forwardly located weight track.
Figure 5:
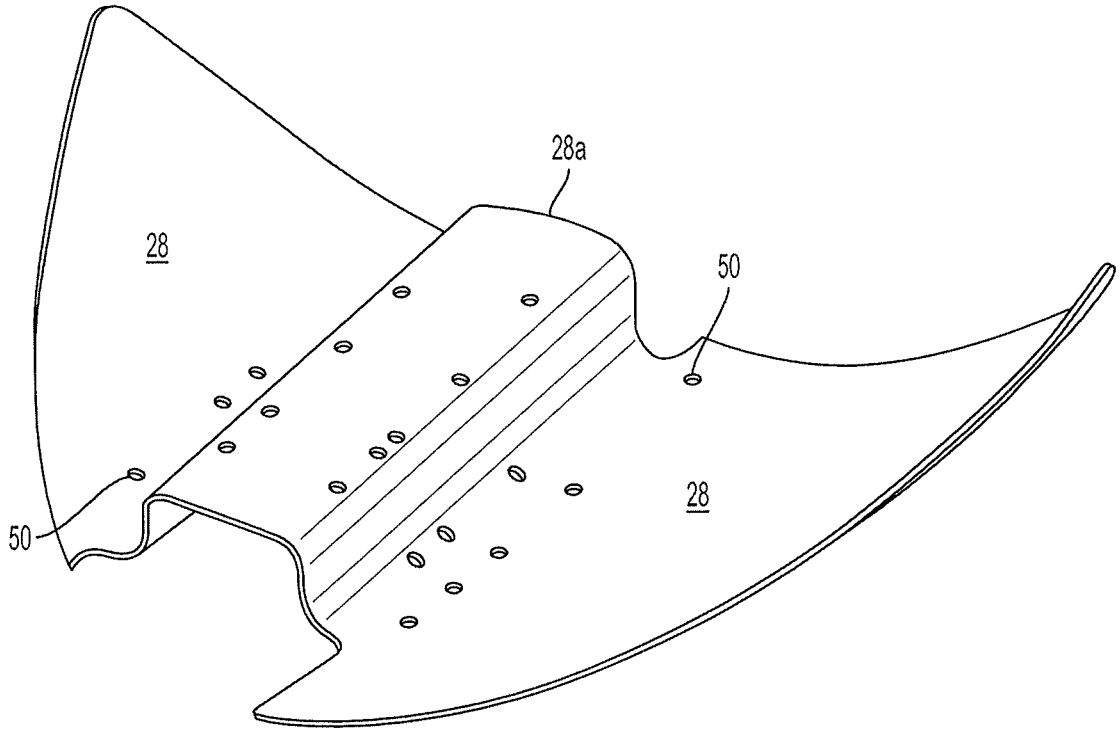
FIG. 5 is a perspective view of a sole insert portion of the golf club head of FIG. 1 or FIG. 2.
Figure 6:
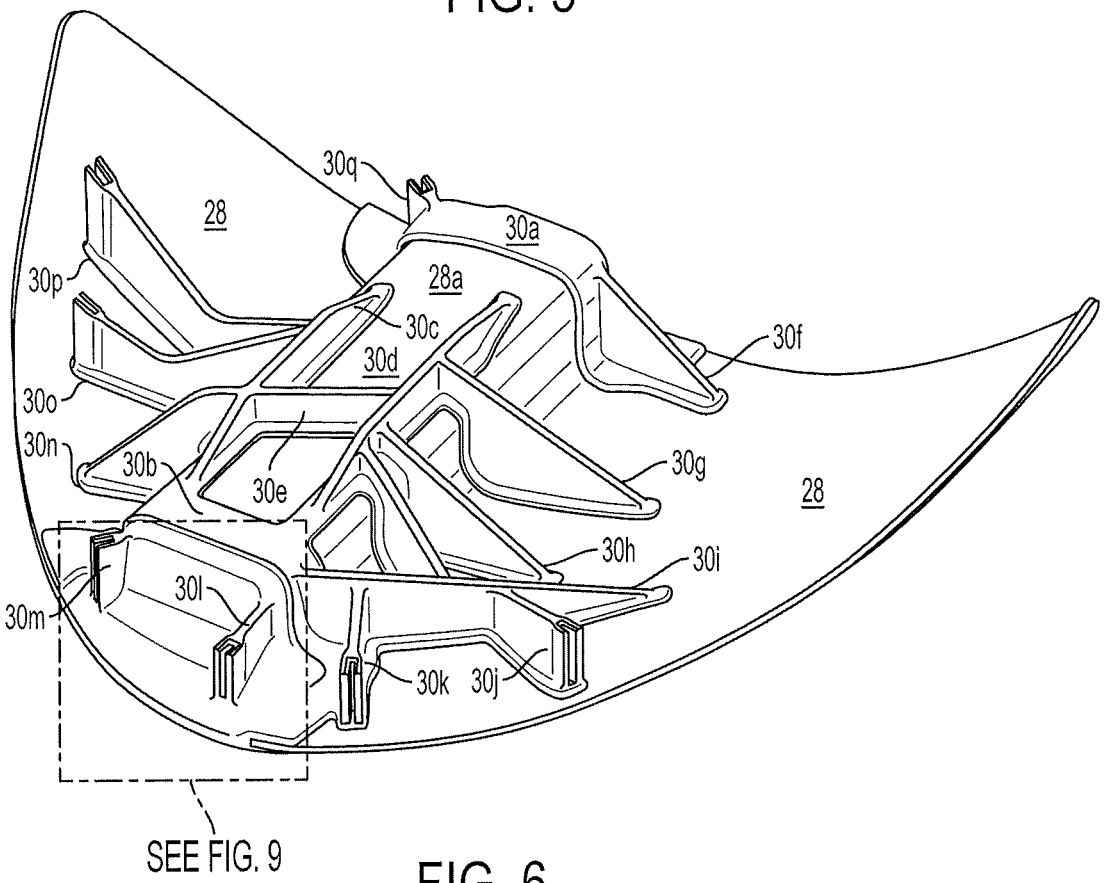
FIG. 6 is a perspective view of the sole insert of FIG. 2 or FIG. 5 with additional features molded over the sole insert.
Figure 7:
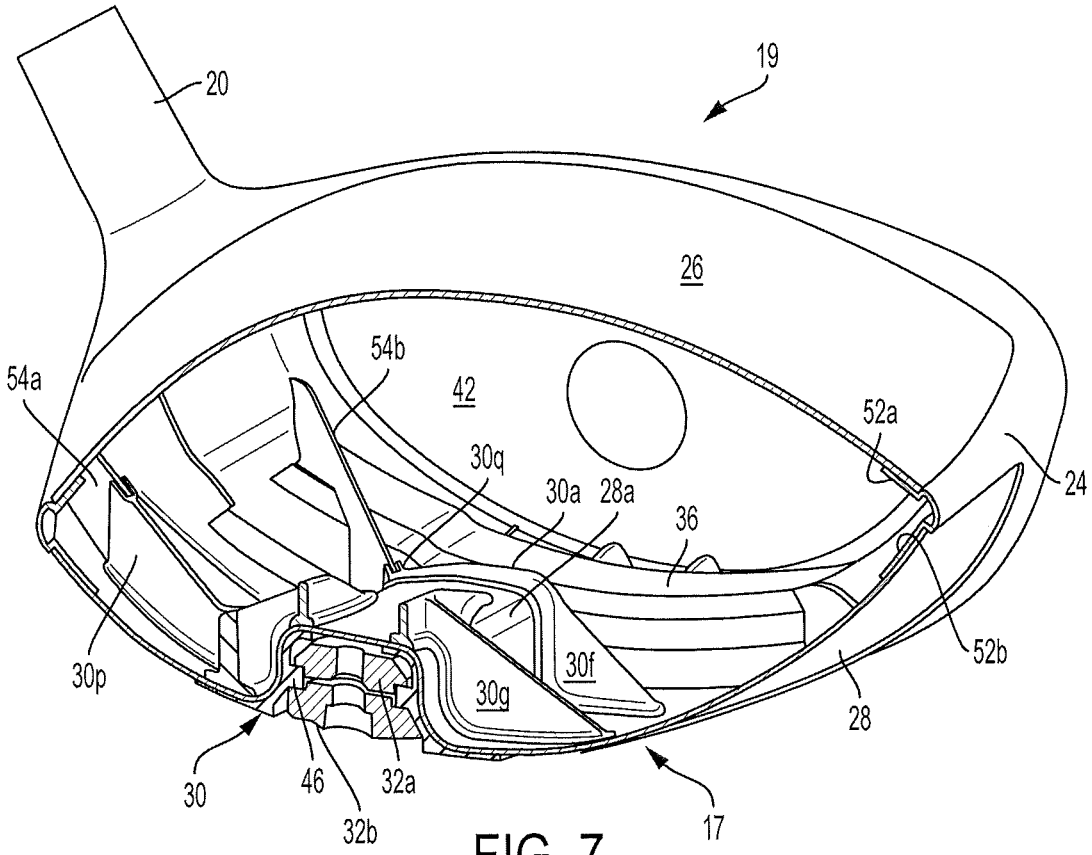
FIG. 7 is a vertical cross section taken generally along line 7-7 of FIG. 1.
Figure 8:
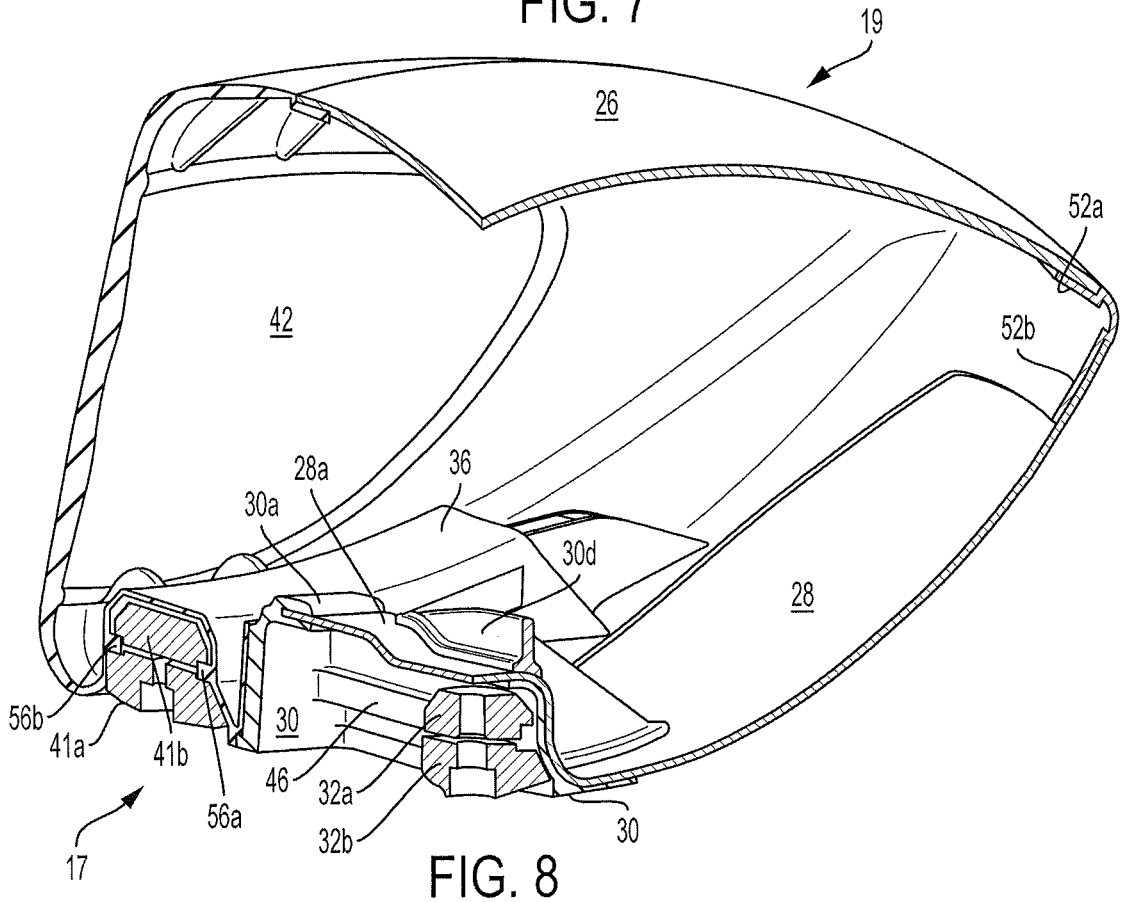
FIG. 8 is a vertical cross section taken generally along line 8-8 of FIG. 3.

In one example, a driver-type club head 10 is shown in FIGS. 1-10. As shown in FIG. 1, the head 10 has a forward face area 12, toe area 14, heel area 16 opposite the toe area 14, and a rear or aft area 18 opposite the forward face area 12. FIGS. 7-8 illustrate other views of the club head 10 including a sole area 17 and crown area 19 opposite the sole area 17. On the heel side of the club head, the head has a hosel 20 to which a golf club shaft may be attached directly or, alternatively, to which a FCT component (flight control technology, also known as an adjustable lie/loft assembly) may be attached as shown in FIG. 2. (The other figures show the hosel 20 without the FCT component attached thereto.)

FIG. 2 is an exploded view of various components of the club head 10. The club head may include a main body or frame 24, crown insert 26, sole insert 28, weight track 30, and FCT component 22. The terms "top cover" or "crown plate" may be used interchangeably herein to describe the crown insert 26. Similarly, the terms "bottom cover" or "sole plate" may be used interchangeably herein to describe the sole insert 28. The crown insert 26 and the sole insert 28 may broadly be referred to as a shell and may be specifically referred to as a "top shell" and a "bottom shell," respectively. The weight track 30 is located in the sole of the club head and defines a track for mounting a two-piece slidable weight 32, which may be fastened to the weight track by a fastening means such as a screw 34. The weight 32 can take forms other than as shown in FIG. 2, can be mounted in other ways, and can take the form of a single piece design or multi-piece design (such as a two-piece design having weight elements 32*a*, 32*b* as shown in FIG. 2). The weight track allows the weight 32 to be loosened for slidable adjustment fore and aft along the track and then tightened in place to adjust the effective CG of the club head in the front to rear direction. By shifting the club head's CG forward or rearward, the performance characteristics of the club head can be modified to affect the flight of the golf ball, especially spin characteristics of the golf ball.

The sole of the frame 24 preferably is integrally formed with a lateral weight track 36, which extends generally parallel to and near the face of the club head and generally perpendicular to the weight track 30. The lateral weight track 36 defines a track or port for mounting (in one exemplary embodiment) one or more slidable weights that are fastened to the weight track. In the example shown in FIG. 2, two two-piece lateral weights 38*a, b*, 39*a, b*, are fastened by fastening means, such as respective screws 40*a*, 40*b*, to the lateral weight track. The weights 38*a, b*, 39*a, b* can take other shapes than as shown, can be mounted in other ways, and can take the form of a single-piece design or multi-piece design.

Figure 3:
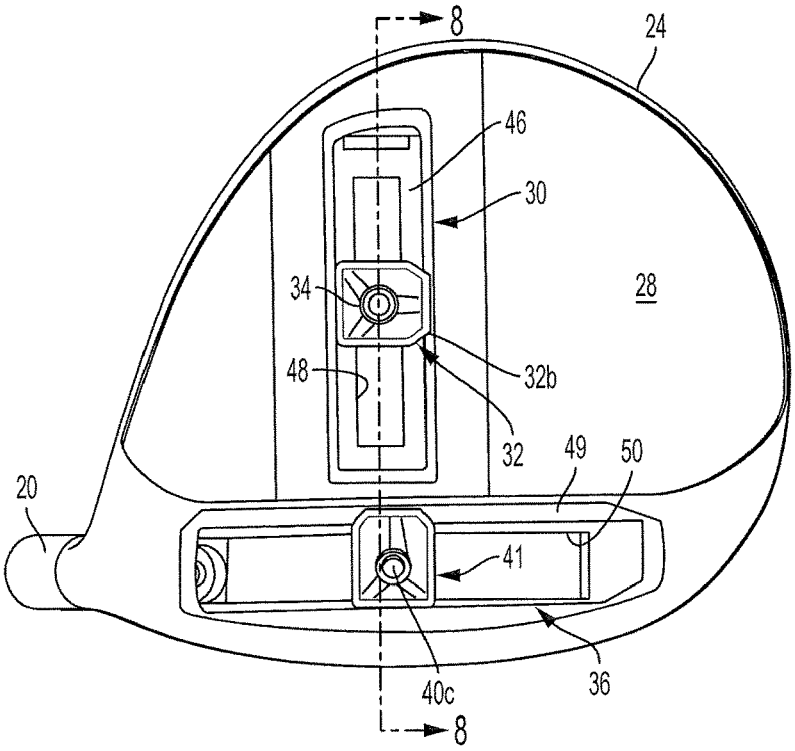
FIG. 3 is bottom plan view of the golf club head of FIG. 1.

Unlike FIG. 2, FIG. 3 shows an embodiment in which the lateral weight track 36 slideably mounts only on one lateral weight 41. The weight 41 may comprise a single weight element, multiple weight elements or two stacked weight elements fastened together by a screw 40. See also FIG. 1 showing a single weight 41 slideably mounted in the weight track.

The lateral weight track of FIG. 2 allows the weights 38, 39 to be loosened for slidable adjustment laterally in the heel-toe direction and then tightened in place to adjust the CG of the club head in the heel-toe direction. This is accomplished by loosening screws 40*a*, 40, adjusting the weights and then tightening the screws 40*a*, 40*b*. By adjusting the CG heelward or toeward, the performance characteristics of the club head can be modified to affect the flight of the ball, especially the ball's tendency to draw or fade, or to counter the ball's tendency to slice or hook. Notably, the use of two weights 38, 39 (FIG. 2) allows for adjustment and interplay between the weights. For example, both weights can be positioned fully on the toe side, fully on the heel side, spaced apart a maximum distance with one weight fully on the toe side and the other fully on the heel side, positioned together in the middle of the weight track, or in other weight location patterns.

With the single lateral weight design shown in FIG. 3, the weight adjustment options are more limited but the effective CG of the head still can be adjusted along a continuum heelward or toeward, or left in a neutral position with the weight centered in the weight track.

The frame 24 preferably has a lower sole opening sized and configured to receive the sole insert 28, and an upper crown opening sized and configured to receive the crown insert 26. More specifically, the sole opening receives a sole insert unit including the sole insert 28 and weight track 30 joined thereto (as described below). The sole and crown openings are each formed to have a peripheral edge or recess to seat, respectively, the sole insert unit and crown insert 26, such that the sole and crown inserts are either flush with the frame 24 to provide a smooth seamless outer surface or, alternatively, slightly recessed.

Though not shown, the frame 24 preferably has a face opening to receive a face plate or strike plate 42 that is attached to the frame by welding, braising, soldering, screws or other fastening means. FIG. 2 and the other figures generally show the face plate already joined to the frame.

The frame 24 may be made from a variety of different types of materials but in one example is made of a metal material such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The frame may be formed by conventional casting, metal stamping or other known processes. The frame also may be made of other metals as well as non-metals. The frame provides a framework or skeleton for the club head to strengthen the club head in areas of high stress caused by the golf ball's impact with the face, such as the transition region where the club head transitions from the face to the crown area, sole area and skirt area located between the sole and crown areas.

In one exemplary embodiment, the sole insert 28 and/or crown insert 26 may be made from a variety of composite and polymeric materials, and preferably from a thermoplastic material, more preferably from a thermoplastic composite laminate material, and most preferably from a thermoplastic carbon composite laminate material. For example, the composite material may be an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42 to 57%) will suffice. The material weighs 200 g/m$^2$.

Another similar exemplary material which may be used for the crown and sole inserts is TEPEX® DYNALITE 208. This material also has a carbon fiber volume range of 42 to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming the sole and crown inserts.

Once the crown insert and sole insert are formed (separately) by the thermoforming process just described, each is cooled and removed from the matched die. The sole and crown inserts are shown as having a uniform thickness, which lends itself well to the thermoforming process and ease of manufacture. However, the sole and crown inserts may have a variable thickness to strengthen select local areas of the insert by, for example, adding additional plies in select areas to enhance durability, acoustic or other properties in those areas.

As shown in FIG. 2, the crown insert 26 and sole insert 28 each have a complex three-dimensional curvature corresponding generally to the crown and sole shapes of a driver-type club head and specifically to the design specifications and dimensions of the particular head designed by the manufacturer. It will be appreciated that other types of club heads, such as fairway wood-type clubs, may be manufactured using one or more of the principles, methods and materials described herein.

In an alternative embodiment, the sole insert 28 and/or crown insert 26 can be made by a process other than thermoforming, such as injection molding or thermosetting. In a thermoset process, the sole insert and/or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the sole (or crown) insert. Each insert is cooled and removed from its respective mold.

The carbon fiber reinforcement material for the thermoset sole/crown insert may be a carbon fiber known as "34-700" fiber, available from Grafil, Inc., of Sacramento, Calif., which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Exemplary epoxy resins for the prepreg plies used to form the thermoset crown and sole inserts are Newport 301 and 350 and are available from Newport Adhesives & Composites, Inc., of Irvine, Calif.

In one example, the prepreg sheets have a quasi-isotropic fiber reinforcement of 34-700 fiber having an areal weight of about 70 g/m$^2$ and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

In a preferred embodiment, the weight track 30 which has more details and 3-D features than the sole insert 28, is made from the same, similar or at least compatible material as the sole insert to allow the weight track to be injection molded, overmolded, or insert molded over the sole insert to bond the two parts together to form the sole insert unit. The weight track 30 preferably is made from a polymeric material suitable for injection molding, preferably a thermoplastic material, more preferably a thermoplastic composite laminate material, and most preferably a thermoplastic carbon composite laminate material. One exemplary material suitable for injection molding is a thermoplastic carbon fiber composite material having short, chopped fibers in a PPS (polyphenylene sulfide) base or matrix. For example, the weight track material may include 30% short carbon fibers (by volume) having a length of about 1/10 inch, which reinforces the PPS matrix.

One example of a commercial material that may be used for the weight track is RTP 1385 UP, made by RTP Company. Other examples include nylon, RTP 285, RTP 4087 UP and RTP 1382 UP. In a preferred example, the crown insert, sole insert and weight track 30 are made from compatible materials capable of bonding well to one another such as polymeric materials having a common matrix or base, or at least complementary matrices. For example, the crown insert and sole insert may be made from continuous fiber composite material well suited for thermoforming while the weight track is made of short fiber composite material well suited for injection molding (including insert molding and overmolding), with each having a common PPS base.

The sole insert unit is formed by placing the thermoplastic composite sole insert 28 in a mold and injection molding the thermoplastic weight track 30 over the sole insert (as, for example, by insert molding or overmolding). The injection molding process creates a strong fusion-like bond between the sole insert and weight track due to their material compatibility, which preferably includes a compatible polymer/matrix (PPS in one preferred example). The terms injection molding (over), insert molding and overmolding generally refer to the same process, but to the extent there are differences, all such processes are believed to be sufficiently similar as to be suitable for forming the sole insert unit.

In the alternative process in which the sole insert 28 is formed using a thermosetting material, the thermoset sole insert and thermoplastic weight track 30 are not compatible materials and will not bond well if left untreated. Accordingly, before the injection molding, insert molding, or overmolding step, the thermoset sole insert 28 preferably is coated with a heat activated adhesive as, for example, ACA 30-114 manufactured by Akron Coating & Adhesive, Inc. ACA 30-114 is a heat-activated water-borne adhesive having a saturated polyurethane with an epoxy resin derivative and adhesion promoter designed from non-polar adherents. It will be appreciated that other types of heat-activated adhesives also may be used.

After the coating step, the coated thermoset sole insert is then placed in a mold and the thermoplastic composite weight track material is overmolded (or injection molded) over the sole insert as described above. During the injection molding step, heat activates the adhesive coating on the sole insert to promote bonding between the sole insert and the weight track material.

Notably, though not necessary, the alternative thermoplastic composite sole insert made using a thermoforming process, as described above, also may be coated with a heat-activated adhesive prior to the overmolding step to promote an even stronger bond with the main body, notwithstanding that the thermoplastic sole insert and weight track thermoplastic material already are compatible for bonding if they have common or at least complementary matrices.

If the crown insert is made from a thermoset material and process, there is no need to coat the crown insert because no thermoplastic material is overmolded to the crown insert in the exemplary embodiments described herein. In the event additional thermoplastic features or 3-D details are overmolded on the crown insert, the same bonding principles discussed with respect to the weight track and sole insert apply.

Once the sole insert unit (sole insert 28 and weight track 30) and crown insert 26 are formed, they are joined to the frame 24 in a manner that creates a strong integrated construction adapted to withstand normal stress, loading and wear and tear expected of commercial golf clubs. For example, the sole insert unit and crown insert each may be bonded to the frame using epoxy adhesive, with the crown insert seated in and overlying the crown opening and the sole insert unit seated in and overlying the sole opening. Alternative attachment methods include bolts, rivets, snap fit, adhesives, other known joining methods or any combination thereof.

FIG. 3 is a bottom plan view of the sole of the club head, including the fore-aft weight track 30 and lateral (or toe-heel) weight track 36. The weight track 30 preferably has a recess, which may be generally rectangular in shape, to provide a recessed track to seat and guide the weight 32 as it adjustably slides fore and aft. Within the recess, the weight track 30 includes a peripheral rail or ledge 46 to define an elongate central opening or channel 48 preferably having a width dimension less than the width of the weight 32. In this way, when the weight 32 is seated flat against the ledge 46, the weight can slide forward and rearward in the weight track while the size and shape of the weight elements 32*a*, 32*b* prevent either one from passing through the channel 48 to the opposite side. At the same time, the channel permits the screw 34 to pass through the center of the weight element 32*b*, through the channel, and then into threaded engagement with the weight element 32*a* (not shown in FIG. 3). The ledge 46 and channel 48 serve to provide tracks or rails on which the joined weight elements 32*a*, 32*b* freely slide while effectively preventing the weight elements from inadvertently slipping through the channel.

FIG. 3 also shows that the weight 41 slideably mounted in the lateral weight track 36 is mounted in the same way as the fore-aft weight 32. Like the weight track 30, the lateral weight track 36 includes a peripheral rail or ledge 49 which defines a channel 50, and slideably mounts the lateral weight 41 for toeward and heelward sliding movement along the weight track. A screw 40*c* attaches the outer weight element shown in FIG. 3 to a companion weight element (hidden) on the other side of the ledge (or rail) 49. In the embodiment shown, the weight element 41 can be adjusted by loosening the screw 40*c* and moving the weight all the way to the toe end of the track, all the way to the heel end of the track, to a neutral position in the middle, or to other locations therebetween. If a second or third weight is added to the weight track, many additional weight location options are available for additional fine tuning of the head's effective CG location in the heel-toe direction.

Figure 4:
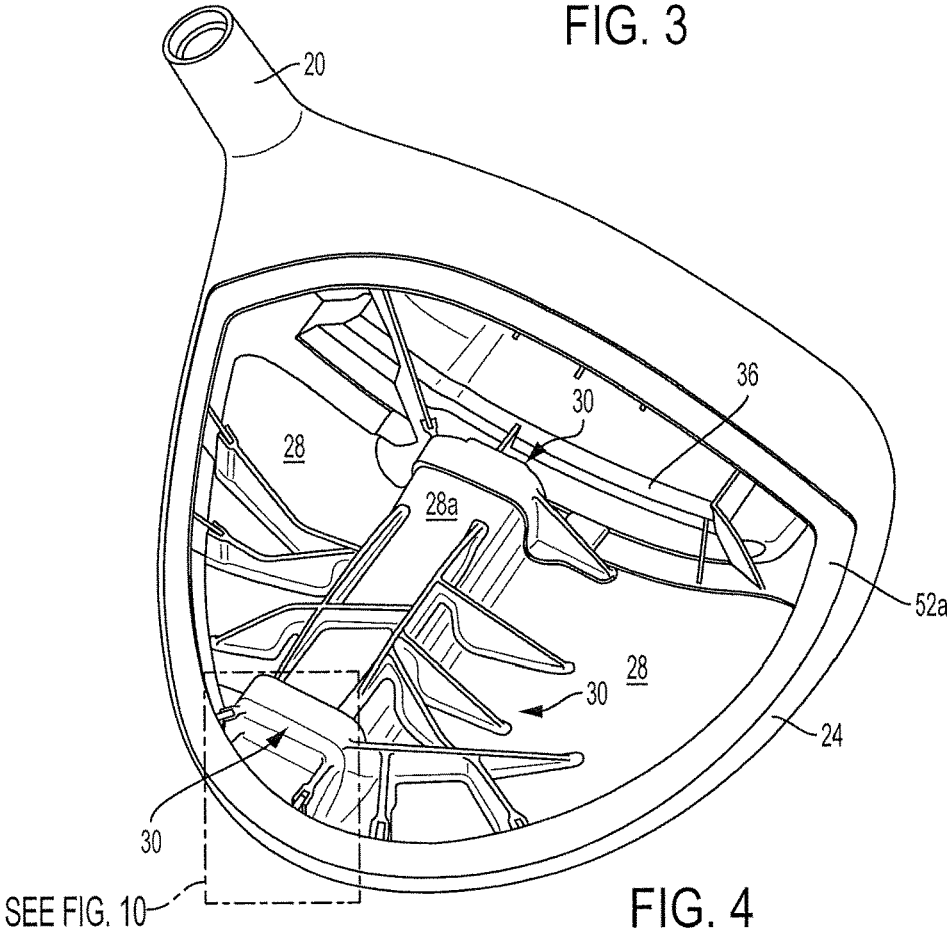
FIG. 4 is a top perspective view of the golf club head of FIG. 1 or FIG. 2 with a crown insert portion removed.

FIG. 4 shows the head with the crown insert 26 removed, and provides a view of the hollow interior of the head from the top. FIG. 4 illustrates how the weight track 30 includes internal ribs, supports and other features overmolded on the sole insert 28. For example, the weight track may include various supports wrapping over a central ridge 28*a* of the sole insert, fore-aft supporting ribs along the top of the ridge 28*a*, and lateral ribs extending outwardly from the central ridge 28. It can be seen that the overmolding process allows the weight track and other intricate features and details to be incorporated into the design of the head. For example, in addition to the performance benefits provided by the weight track, the various ribs and features shown in FIG. 4 can provide structural support and additional rigidity for the club head and also modify and even fine tune the acoustic properties of the club head. The sound and modal frequencies emitted by the club head when it strikes the ball are very important to the sensory experience of the golfer and provides functional feedback as to where the ball impact occurs on the face (and whether the ball is well struck).

FIG. 5 shows the sole insert 28, including its central rib or ridge 28*a*, before the weight track 30 has been overmolded thereto. The ridge 28*a* is centrally located on the sole insert and extends generally from front to back to provide additional structural support for the sole of the club head. The ridge 28*a* also provides an elongate weight recess or port on its outer surface within which to seat the fore-aft weight track 30. The sole insert may include a plurality of through holes 50 in various locations to provide a flow path for injection mold melt during the injection molding step and create a mechanical interlock between the sole insert 28 and overmolded weight track 30, thereby forming the sole insert unit.

FIG. 6 shows in greater detail the sole insert 28 with the overmolded weight track 30 joined thereto. It can be seen (especially in the context of the other figures) that the weight track 30 wraps around both sides (interior and exterior) of the sole insert. In addition to the channel 48 and peripheral ledge (or rail) 46 overmolded on the outer surface of the sole insert, the weight track 30 also preferably includes one or more ribs and other features on the interior surface of the sole insert. For example, FIG. 6 shows reinforcing supports 30*a*, 30*b* draped over opposite ends of the ridge 28*a*, parallel fore-aft extending ribs 30*c*, 30*d* tracking along the top of the ridge 28*a*, cross-rib 30*e* connecting the ribs 30*c*, 30*d*, and various lateral and other ribs 30*f*, 30*g*, 30*h*, 30*i*, 30*j*, 30*k*, 30*l*, 30*m*, 30*n*, 30*o*, 30*p*, and 30*q*, which are all interconnected to form a reinforcing network or matrix of supporting ribs and supports to reinforce the sole insert and club head.

Equally important, since the ribs are injection molded they can have a wide variety of shapes, sizes, orientations, and locations on the sole insert to adjust and fine tune acoustic properties of the club head. It can be seen in FIG. 6 that the rib network adds rigidity in both the lateral and longitudinal directions and thereby imparts strategically located stiffness to the club head. In this regard, some of the ribs, such as ribs 30*j*, 30*k*, 30*l*, 30*m*, 30*o*, 30*p*, and 30*q*, have forked ends to engage mating structural elements on the frame 24, thereby aligning the sole insert for attachment to the frame as well as providing a strong mechanical bond between the sole insert unit and frame. While the overmolded component of the illustrated embodiment is shown as a structure that provides a weight track to support a slidable weight, as well as reinforcing and acoustic elements, it will be appreciated that the overmolded component can take other forms to provide other 3-D features and functions.

FIG. 7 is a vertical cross-section view showing the hollow interior of the club head, as viewed from the aft end looking forward toward the face. The frame 24 preferably includes a recessed seat or ledge 52*a* extending around the crown opening to seat the crown insert 26. Similarly, the frame 24 includes a seat or ledge 52*b* around the sole opening to receive the sole insert 28. The weight elements 32*a*, 32*b* of the weight 32 are shown seated in their respective channels and separated by rail 46. Weight elements 32*a*, 32*b* are shown having aligned bores to receive the screw 34 (FIGS. 1, 2). The bore of the weight element 32*a* is threaded such that loosening of the screw 34 separates the weight elements to allow sliding movement fore and aft within the weight track, while tightening the screw pulls the weights together into locking engagement with the rail 46 to prevent sliding movement during play on the golf course.

FIG. 7 also illustrates how the lateral weight track 36 spans the front of the club head sole in proximity to a lower end of the face plate 42.

FIG. 7 further illustrates how two of the ribs 30*p*, 30*q* having forked (or channeled) ends to securely engage respective ends of reinforcing flanges (or ribs) 54*a*, 54*b*. The flanges 54*a*, 54*b* and others not shown may be integrally formed as part of the frame 24. It will be appreciated that the other thermoplastic weight track ribs having forked ends similarly interlock with other ribs formed as part of the frame 24.

FIG. 8 is a vertical cross-section showing the interior of the hollow club head from another perspective, and looking generally from the heel side toward the toe side. The figure illustrates how the fore-aft weight track 30 and a two-piece weight 32 (with weight elements 32*a*, 32*b*) is very similar to the lateral weight track 36 and two-piece weight 41 (which includes weight elements 41*a*, 41*b*). Unlike the weight track 30, however, in the exemplary embodiment shown the weight track 36, which includes parallel rails or ledges 56*a*, 56*b*, are formed as an integral part of the frame 24. Alternatively, the weight track 36 may be formed as a component which is injection molded over an elongate recessed channel or port formed within the frame 24, much like weight track 30. The manner in which the weight 41 is tightened, loosened and slidably adjusted is as described above in connection with the weight track 30.

Figure 9:
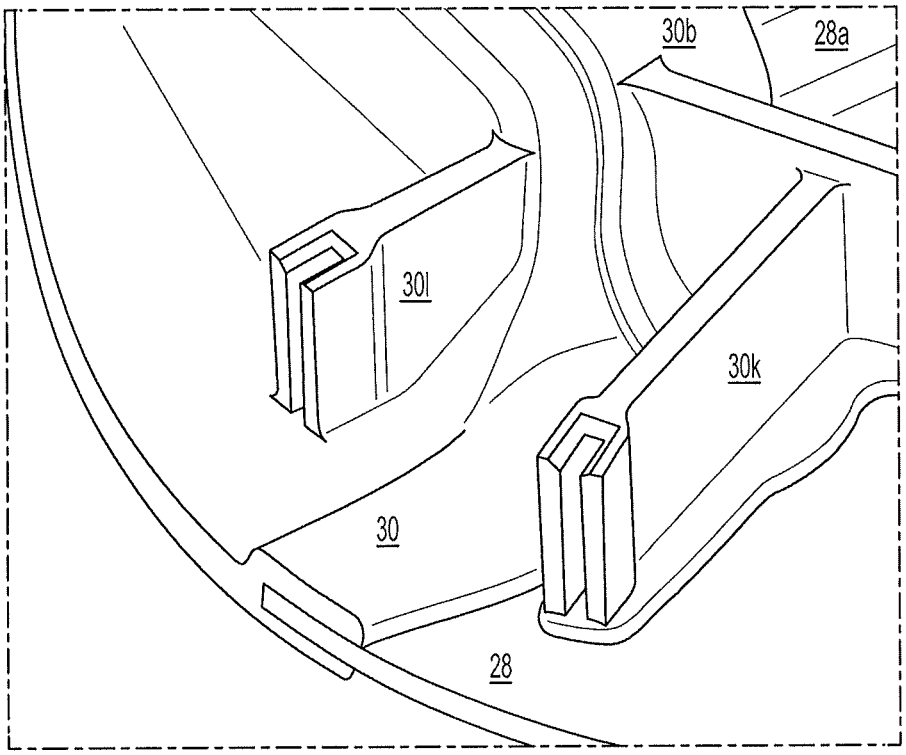
FIG. 9 is an enlarged view of a portion of FIG. 6.
Figure 10:
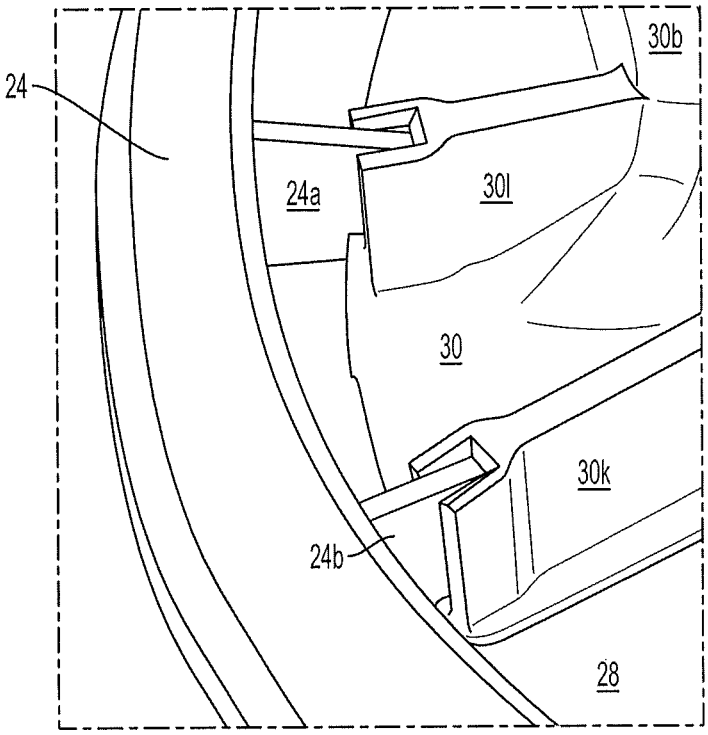
FIG. 10 is an enlarged view of a portion of FIG. 4 and viewed from a slightly different perspective.

FIG. 9 is an enlarged portion of FIG. 6 showing in greater detail one of the seams, joints or interface sections where the sole insert 28 and weight track 30 are joined. Support portion 30*b* is shown supportively draped over one end of the ridge 28*a* of the sole insert 28. The forked ends of the ribs 30*l*, 30*k* form channels ready to receive respective ends of flanges or ribs joined to the frame 24. These flanges or ribs are designated as 24*a*, 24*b* in FIG. 10, which is an enlarged view of a portion of FIG. 4. Unlike FIG. 9, FIG. 10 shows the frame 24 and illustrates how ribs 30*l*, 30*k* mate with the ends of respective flanges 24*a*, 24*b*.

The composite sole and weight track disclosed in various embodiments herein overcome manufacturing challenges associated with conventional club heads having titanium or other metal weight tracks, and replace a relatively heavy weight track with a light composite material (freeing up discretionary mass which can be strategically allocated elsewhere within the club head). For example, additional ribs can be strategically added to the hollow interior of the club head and thereby improve the acoustic properties of the head. Ribs can be strategically located to strengthen or add rigidity to select locations in the interior of the head. Discretionary mass in the form of ribs or other features also can be strategically located in the interior to shift the effective CG fore or aft, toeward or heelward or both (apart from any further CG adjustments made possible by slidable weight features).

Also, embodiments described herein having continuous fiber composite sole and crown inserts are especially effective in providing improved structural support and stiffness to the club head, as well as freeing up discretionary mass that can be allocated elsewhere.

In the embodiment shown in FIGS. 11-16, the head 100 has a forward face area 242, and a main body or frame 224, a crown insert 226 and sole insert 228, both inserts made from a composite material, a weight track 236, and a hosel 222. The weight track 236 is located in the frame in the sole of the club head and defines a track for mounting a two-piece slidable weight 241, which may be fastened to the weight track by a fastening means such as a screw 240. The weight 241 can take forms other than as shown and can be mounted in other ways, and can take the form of a single piece design or multi-piece design (such as a two-piece design having weight elements 32*a*, 32*b* as shown in FIG. 2). The weight track allows the weight 241 to be slidably adjusted along the track and then tightened in place to adjust the effective CG and MOI of the club head as desired by the user. Further adjustment is also obtained by the location of additional weighting towards of the club head by location of additional movable weight 262 in the rear of the frame of the clubhead. Thus varying the relative magnitude of the slidably adjusted weight 236 and the rearward weight 262 allows for further adjustment of the club head's CG forward or rearward and the performance characteristics of the club head to affect the flight of the golf ball, especially spin characteristics of the golf ball. In some embodiments the fastening system of the slidably adjusted weight 236 and the rearward weight 262 will utilize the same threaded screw 240 facilitating the user ability to swap the weights using the same tool to achieve the desired performance.

Figure 13:
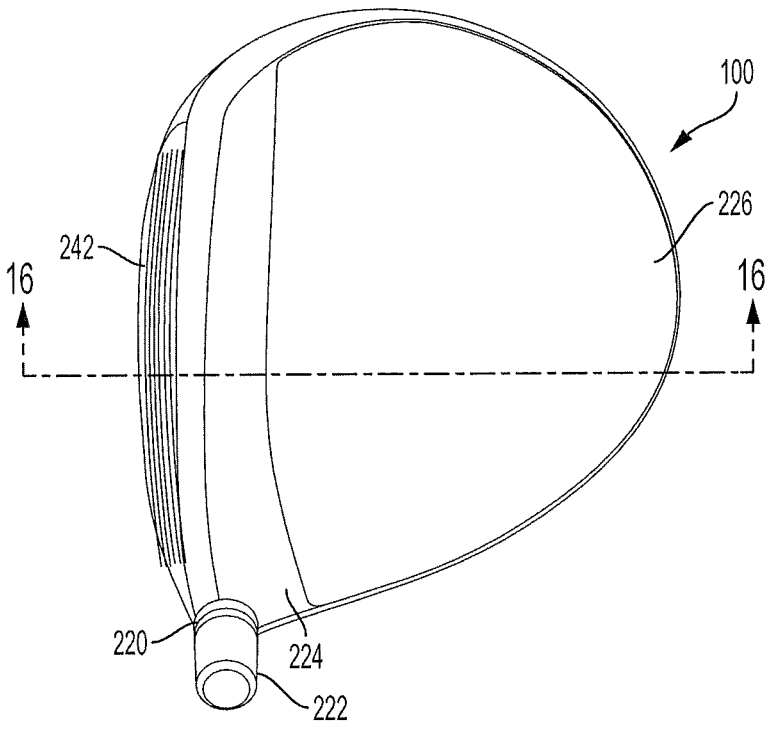
FIG. 13 is a top view of a golf club head of the present invention.
Figure 14:
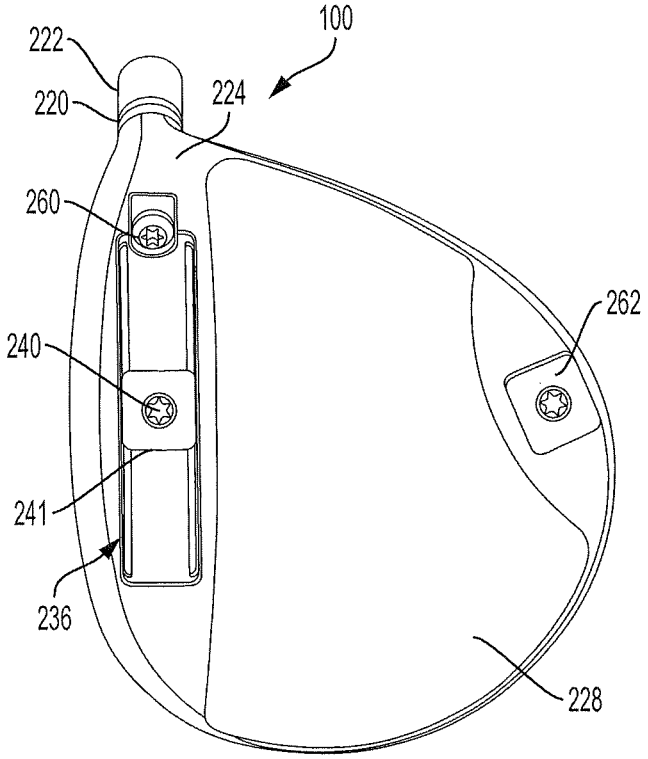
FIG. 14 is a bottom view of a golf club head of the present invention.
Figure 15:
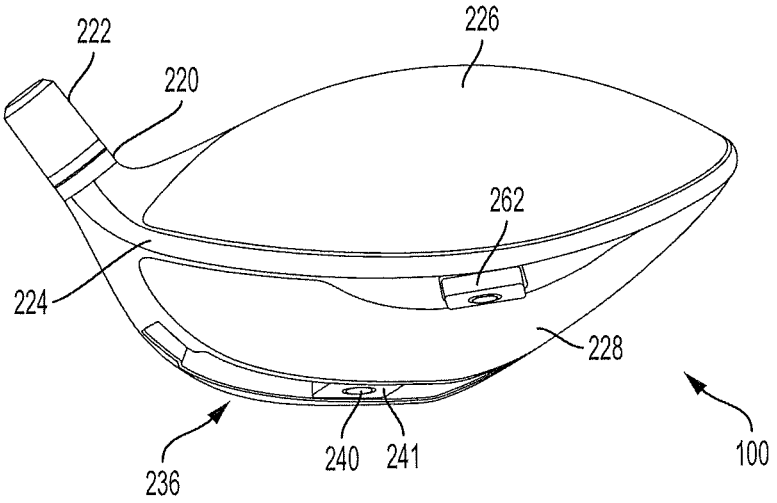
FIG. 15 is side view a golf club head of the present invention showing the positioning of a rear fixed weight and sliding front weight.
Figure 16:
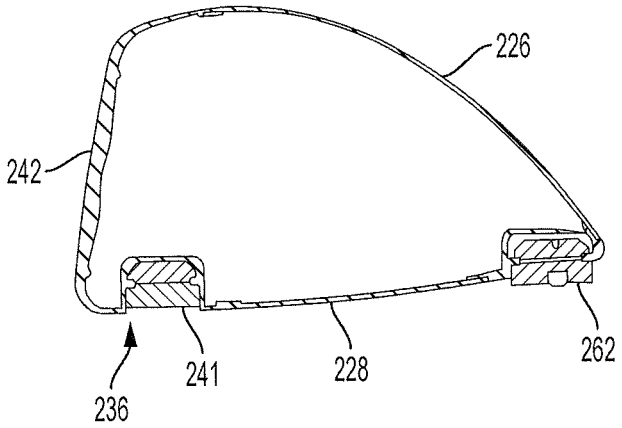
FIG. 16 vertical cross section taken generally along line 16-16 of FIG. 13.

As shown in FIG. 13 and the cross sectional view in FIG. 16, the frame 224 preferably has a lower sole opening sized and configured to receive the composite sole insert 228, and an upper crown opening sized and configured to receive the composite crown insert 226. More specifically, the sole opening receives a sole insert unit including the sole insert 228. The sole and crown openings are each formed to have a peripheral edge or recess to seat, respectively, the sole insert unit 228 and crown insert 226, such that the sole and crown inserts are either flush with the frame 224 to provide a smooth seamless outer surface or, alternatively, slightly recessed.

Figure 11:
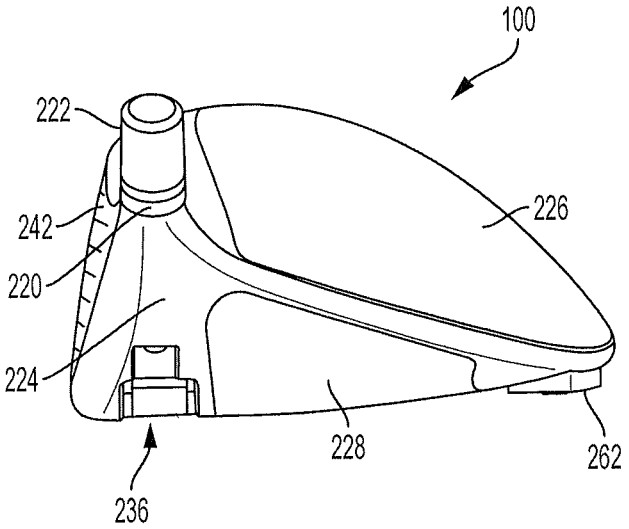
FIG. 11 is a side view of another embodiment golf club head of the present invention.
Figure 12:
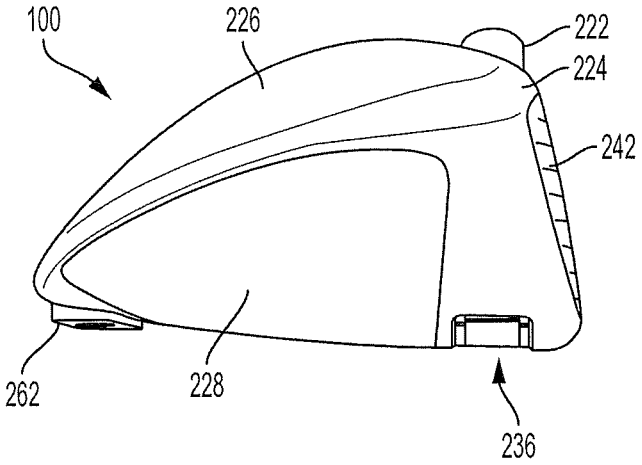
FIG. 12 is the opposite side view of the golf club head of FIG. 11.

Though not shown, the frame 224 preferably has a face opening to receive a face plate or strike plate 242 that is attached to the frame by welding, braising, soldering, screws or other fastening means. FIG. 11 and the other figures generally show the face plate already joined to the frame.

Figure 17:
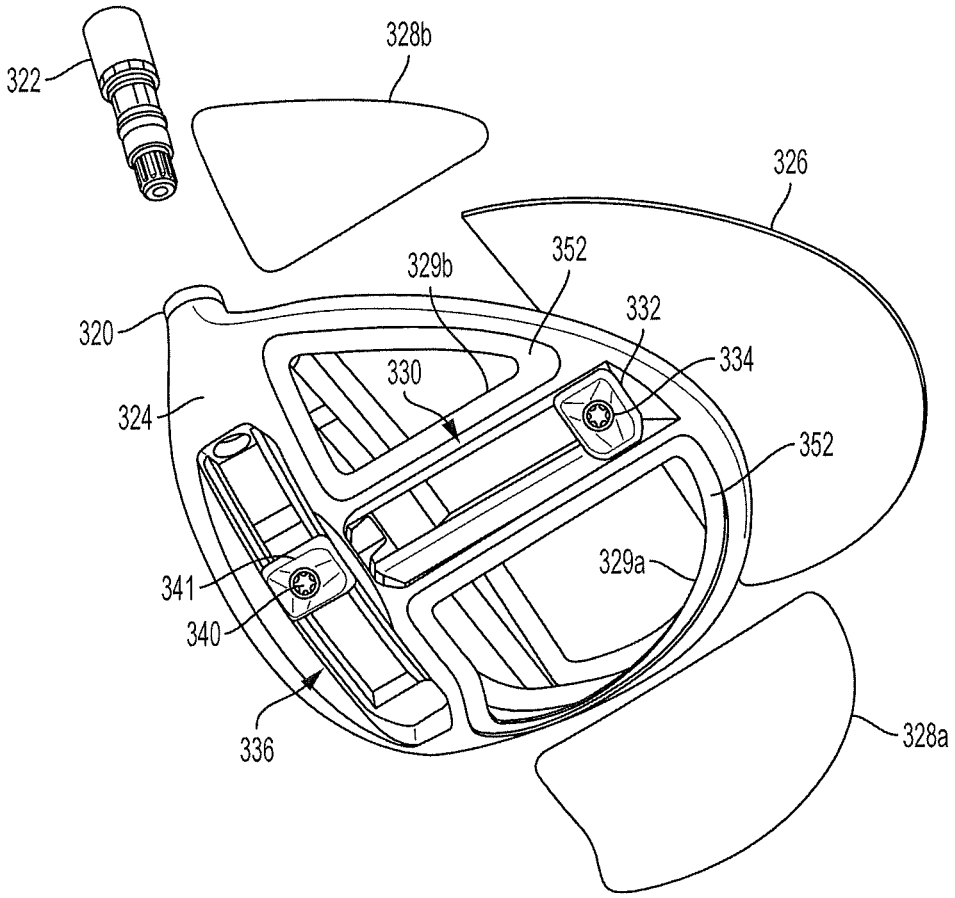
FIG. 17 is an exploded bottom view of another embodiment golf club head of the present invention.
Figure 18:
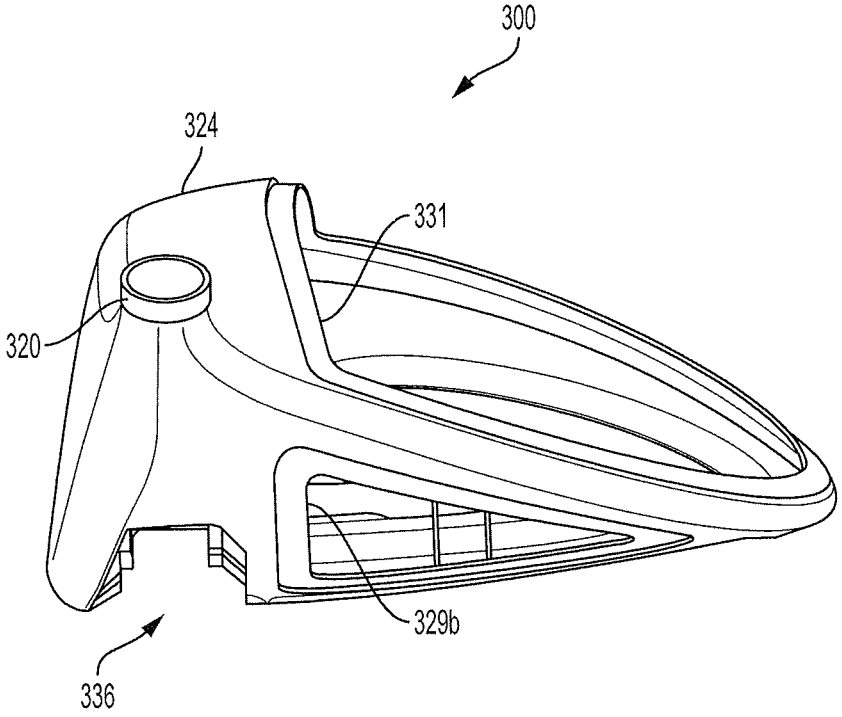
FIG. 18 is a side view of a golf club head of the present invention.
Figure 19:
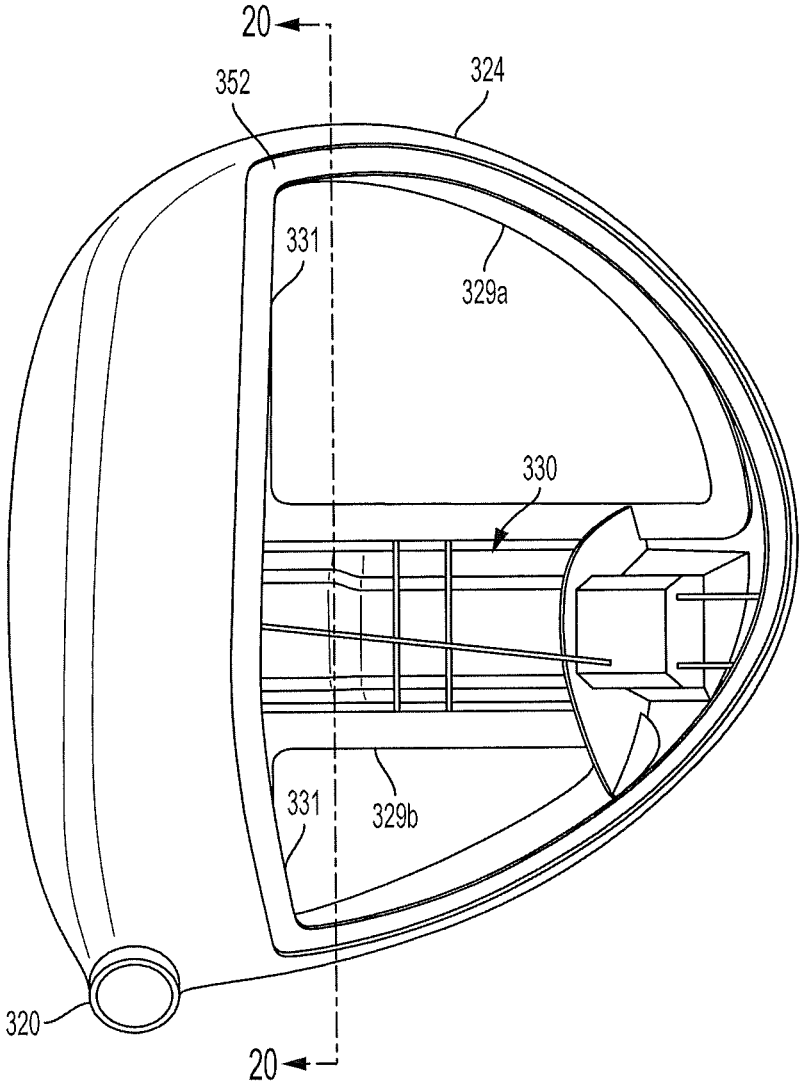
FIG. 19 is a top view of a golf club head of the present invention with the top panel removed.

FIGS. 17-20, show another embodiment of the golf club-head of the present invention. FIG. 17 is an exploded view of various components of the club head 300. The club head may include a main body or frame 324, crown insert 326, and two sole sole inserts 328*a* and 328*b*, weight track 330, and FCT component 322. The weight track 330 is located in the sole of the club head and defines a track for mounting a two-piece slidable weight 332, which may be fastened to the weight track by a fastening means such as a screw 334. The weight 332 can take forms other than as shown in FIG. 17, can be mounted in other ways, and can take the foim of a single piece design or multi-piece design (such as a dual weight design having weight elements 32*a*, 32*b* as shown in FIG. 2). The weight track allows the weight 332 to be loosened for slidable adjustment fore and aft along the track and then tightened in place to adjust the effective CG of the club head in the front to rear direction. By shifting the club head's CG forward or rearward, the performance characteristics of the club head can be modified to affect the flight of the golf ball, especially spin characteristics of the golf ball.

The sole of the frame 324 preferably is integrally formed with a lateral weight track 336, which extends generally parallel to and near the face of the club head and generally perpendicular to the weight track 330. The lateral weight track 336 defines a track or port for mounting (in one exemplary embodiment) one or more slidable weights that are fastened to the weight track. In the present embodiment the lateral weight track 336 slideably mounts only on one lateral weight 341. The weight 341 may comprise a single weight element, multiple weight elements or two stacked weight elements fastened together by a screw 340.

The lateral weight track of FIG. 17 allows the weights 341 to be loosened for slidable adjustment laterally in the heel-toe direction and then tightened in place to adjust the CG of the club head in the heel-toe direction. This is accomplished by loosening screw 340, adjusting the weight and then tightening the screws 340. By adjusting the CG heelward or toeward, the performance characteristics of the club head can be modified to affect the flight of the ball, especially the ball's tendency to draw or fade, or to counter the ball's tendency to slice or hook.

Figure 20:
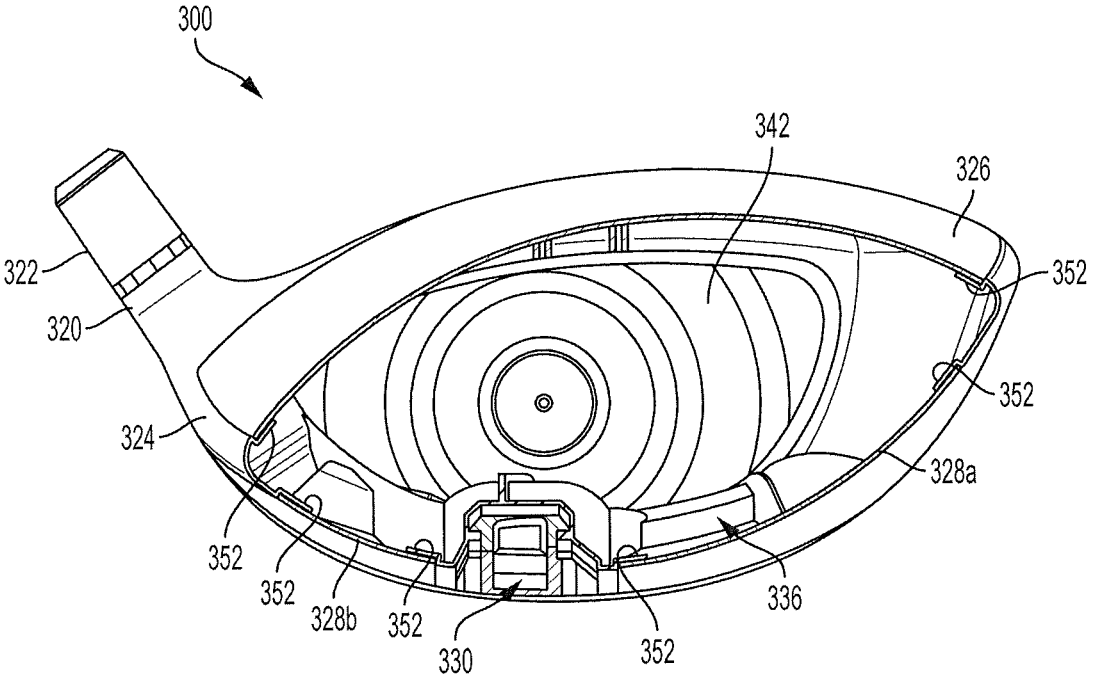
FIG. 20 is a rear view of a golf club head of the present invention with the face removed.

The frame 324 preferably has two lower sole openings 329 *a* and 329*b* sized and configured to receive the sole inserts 328*a* and 328*b* respectively, and an upper crown opening 331 sized and configured to receive the crown insert 326. The sole and crown openings are each formed to have a peripheral edges or recess 352 as shown in FIG. 20 to seat, respectively, the sole insert units 328*a* and 328*b*, such that the sole and crown inserts are either flush with the frame 324 to provide a smooth seamless outer surface or, alternatively, slightly recessed.

Though not shown, the frame 324 preferably has a face opening to receive a face plate or strike plate 342 that is attached to the frame by welding, braising, soldering, screws or other fastening means.

In the golf club heads of the present invention, the ability to adjust the relative magnitude of the slidably adjusted weights and rearward weights coupled with the weight saving achieved by incorporation of the composite sole and crown inserts allows for a large range of variation of a number properties of the club-head all of which affect the ultimate club-head performance including both the position of the CG of the club-head and its various MOI values.

Generally, the center of gravity (CG) of a golf club head is the average location of the weight of the golf club head or the point at which the entire weight of the golf club-head may be considered as concentrated so that if supported at this point the head would remain in equilibrium in any position. A club head origin coordinate system can be defined such that the location of various features of the club head, including the CG can be determined with respect to a club head origin positioned at the geometric center of the striking surface and when the club-head is at the normal address position (i.e., the club-head position wherein a vector normal to the club face substantially lies in a first vertical plane perpendicular to the ground plane, the centerline axis of the club shaft substantially lies in a second substantially vertical plane, and the first vertical plane and the second substantially vertical plane substantially perpendicularly intersect).

The head origin coordinate system defined with respect to the head origin includes three axes: a z-axis extending through the head origin in a generally vertical direction relative to the ground; an x-axis extending through the head origin in a toe-to-heel direction generally parallel to the striking surface (e.g., generally tangential to the striking surface at the center) and generally perpendicular to the z-axis; and a y-axis extending through the head origin in a front-to-back direction and generally perpendicular to the x-axis and to the z-axis. The x-axis and the y-axis both extend in generally horizontal directions relative to the ground when the club head is at the normal address position. The x-axis extends in a positive direction from the origin towards the heel of the club head. The y axis extends in a positive direction from the head origin towards the rear portion of the club head. The z-axis extends in a positive direction from the origin towards the crown. Thus for example, and using millimeters as the unit of measure, a CG that is located 3.2 mm from the head origin toward the toe of the club head along the x-axis, 36.7 mm from the head origin toward the rear of the clubhead along the y-axis, and 4.1 mm from the head origin toward the sole of the club head along the z-axis can be defined as having a $CG_x$ of −3.2 mm, a $CG_y$ of −36.7 mm, and a $CG_z$ of −4.1 mm.

Further as used herein, Delta 1 is a measure of how far rearward in the club head body the CG is located. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the club head face. Thus, for embodiments of the disclosed golf club heads in which the projected CG on the ball striking club face is lower than the geometric center, reducing Delta 1 can lower the projected CG and increase the distance between the geometric center and the projected CG. Recall also that a lower projected CG creates a higher dynamic loft and more reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

Similarly Delta 2 is the distance between the CG and the hosel axis along the x axis (in the direction straight toward the back of the body of the golf club face from the geometric center of the striking face).

Adjusting the location of the discretionary mass in a golf club head as described above can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

In addition to the position of the CG of a club-head with respect to the head origin another important property of a golf club-head is a projected CG point on the golf club head striking surface which is the point on the striking surface that intersects with a line that is normal to the tangent line of the ball striking club face and that passes through the CG. This projected CG point ("CG Proj") can also be referred to as the "zero-torque" point because it indicates the point on the ball striking club face that is centered with the CG. Thus, if a golf ball makes contact with the club face at the projected CG point, the golf club head will not twist about any axis of rotation since no torque is produced by the impact of the golf ball. A negative number for this property indicates that the projected CG point is below the geometric center of the face.

In terms of the MOI of the club-head (i.e., a resistance to twisting) it is typically measured about each of the three main axes of a club-head with the CG as the origin of the coordinate system. These three axes include a CG z-axis extending through the CG in a generally vertical direction relative to the ground when the club head is at normal address position; a CG x-axis extending through the CG origin in a toe-to-heel direction generally parallel to the striking surface (e.g., generally tangential to the striking surface at the club face center), and generally perpendicular to the CG z-axis; and a CG y-axis extending through the CG origin in a front-to-back direction and generally perpendicular to the CG x-axis and to the CG z-axis. The CG x-axis and the CG y-axis both extend in generally horizontal directions relative to the ground when the club head is at normal address position. The CG x-axis extends in a positive direction from the CG origin to the heel of the club head. The CG y-axis extends in a positive direction from the CG origin towards the rear portion of the golf club head. The CG z-axis extends in a positive direction from the CG origin 150 towards the crown 112. Thus, the axes of the CG origin coordinate system are parallel to corresponding axes of the head origin coordinate system. In particular, the CG z-axis is parallel to z-axis, the CG x-axis is parallel to x-axis, and CG y-axis is parallel to y-axis.

Specifically, a club head as a moment of inertia about the vertical axis ("Izz"), a moment of inertia about the heel/toe axis ("Ixx"), and a moment of inertia about the front/back axis ("Iyy"). Typically, however, the MOI about the z-axis (Izz) and the x-axis (Ixx) is most relevant to club head forgiveness.

A moment of inertia about the golf club head CG x-axis (Ixx) is calculated by the following equation:

$$Ixx=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following equation:

$$Izz=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

A further description of the coordinate systems for determining CG positions and MOI can be found US Patent Publication No. 2012/0172146 A1 publishing on Jul. 5, 2012, the entire contents of which is incorporated by reference herein.

As shown in Table 1 below, the clubs of the present invention are able to achieve extremely high ranges of CGx, CGy, Delta 1 and Delta 2 and lxx, Iyy and projected CG position "BP" within the adjustability ranges of the club head. The values measured in Table 1 where obtained for a club-head having a volume of 452 cm3 when measured with an open front track and varying the distribution of the total discretionary weight as represented by the total; weight of the slidably adjusted weight 236 and the rearward weight 262 (which in the below example totals 44 g) by distributing it between the "front position ie the center point of the weight track 236 and the back position ie the location of the weight port of rearward weight 262.

TABLE 1

| Front Mass (g) | Back Mass (g) | CGx (mm) | CGz (mm) | Delta 1 (mm) | Delta 2 (mm) | Final Club-Head Mass (g) | $I_{XX}$ (kg-mm$^2$) | $I_{ZZ}$ (kg-mm$^2$) | CG Proj (mm) |
|---|---|---|---|---|---|---|---|---|---|
| 44 | 0 | 0.41 | −5.89 | 9.6 | 32.9 | 205.1 | 225 | 347 | −1.5 |
| 39.8 | 4.1 | 0.22 | −5.78 | 11.3 | 33.1 | 205 | 248 | 372 | −1.1 |
| 35.1 | 9.1 | 0 | −5.66 | 13.4 | 33.4 | 205.3 | 274 | 399 | −0.6 |
| 30 | 14 | −0.24 | −5.52 | 15.5 | 33.7 | 205.1 | 299 | 425 | −0.1 |
| 24.9 | 19 | −0.46 | −5.37 | 17.6 | 33.9 | 205 | 321 | 449 | 0.4 |
| 20.1 | 24 | −0.69 | −5.25 | 19.6 | 34.2 | 205.2 | 342 | 471 | 0.9 |
| 15 | 29 | −0.92 | −5.1 | 21.7 | 34.5 | 205 | 361 | 492 | 1.4 |
| 9.9 | 34.4 | −1.17 | −4.99 | 24 | 34.7 | 205.3 | 380 | 512 | 1.9 |
| 4.9 | 39.3 | −1.4 | −4.85 | 26 | 35 | 205.3 | 396 | 528 | 2.4 |
| 0 | 44.2 | −1.62 | −4.71 | 28.1 | 35.3 | 205.4 | 409 | 543 | 2.9 |

The overmolded thermoplastic component described herein, exemplified by the weight track and ribs/support matrix incorporated into the weight track, illustrates the possibilities for adding design complexities and intricacies to the sole and crown portions of the club head, by overmolding or injection molding 3-dimensional or other features while integrating large composite portions of the head with metal portions. In addition to the one or more weight tracks, and support members and ribs described herein, incorporation of other features may also be facilitated to differing degrees by their overmolding or injection molding over a composite laminate sole and/or crown insert or, alternatively, over a composite laminate shell forming the crown, sole and/or skirt of the club head, as described herein, such features including;

1. movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;

2. slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3. aerodynamic shape features including those described in more detail in U.S. Patent Publication No. 2013/0123040A1, the entire contents of which are incorporated by reference herein in their entirety;
4. removable shaft features including those described in more detail in U.S. Pat. No. 8,303,431, the contents of which are incorporated by reference herein in in their entirety;
5. adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
6. adjustable sole features including those described in more detail in U.S. Pat. No. 8,337,319, U. S. Patent Publication Nos. US2011/0152000A1, US2011/0312437, US2012/0122601A1, and U.S. patent application Ser. No. 13/686,677, the entire contents of each of which are incorporated by reference herein in their entirety.

For example, as disclosed in U.S. Pat. No. 7,540,811 a golf club head may have a volume equal to the volumetric displacement of the club head body. In other words, for a golf club head with one or more weight ports within the head, it is assumed that the weight ports are either not present or are "covered" by regular, imaginary surfaces, such that the club head volume is not affected by the presence or absence of ports. A golf club head of the present application can be configured to have a head volume between about 110 cm3 and about 600 cm3. In more particular embodiments, the head volume is between about 250 cm3 and about 500 cm3. In yet more specific embodiments, the head volume is between about 300 cm3 and about 500 cm3, between 300 cm3 and about 360 cm3, between about 300 cm3 and about 420 cm3 or between about 420 cm3 and about 500 cm3.

Figure 21:
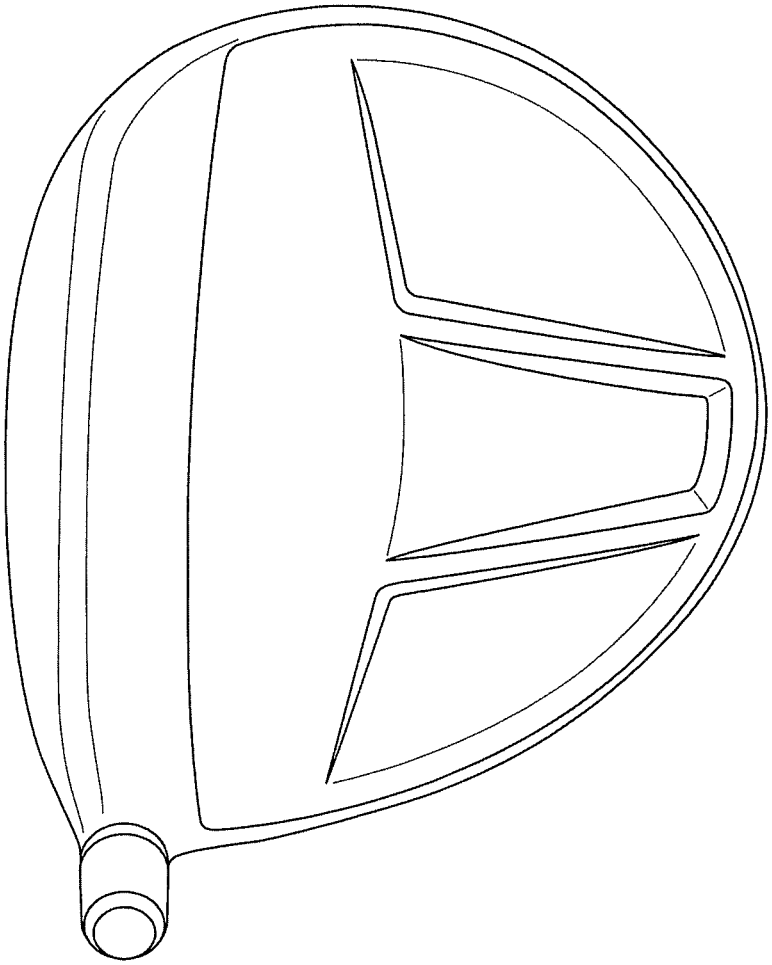
FIG. 21 is a top plan view of a golf club head in accordance with another embodiment.

The designs, embodiments and features described herein may also be combined with other features and technologies in the club-head including;

1. variable thickness face features described in more detail in U.S. patent application Ser. No. 12/006,060, U.S. Pat. Nos. 6,997,820, 6,800,038, and 6,824,475, which are incorporated herein by reference in their entirety;
2. composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety;

An additional embodiment of a golf club head 400 is shown in FIGS. 21-26. As shown in FIG. 21, the head 400 includes a forward face area 412, toe area 414, heel area 416 opposite the toe area 414, and a rear or aft area 418 opposite the forward face area 412. FIG. 21 also shows a downward looking view of the club head's upper surface or crown, and a hosel 420 to which a shaft may be attached directly (or alternatively to which a FCT component may be attached).

Figure 22:
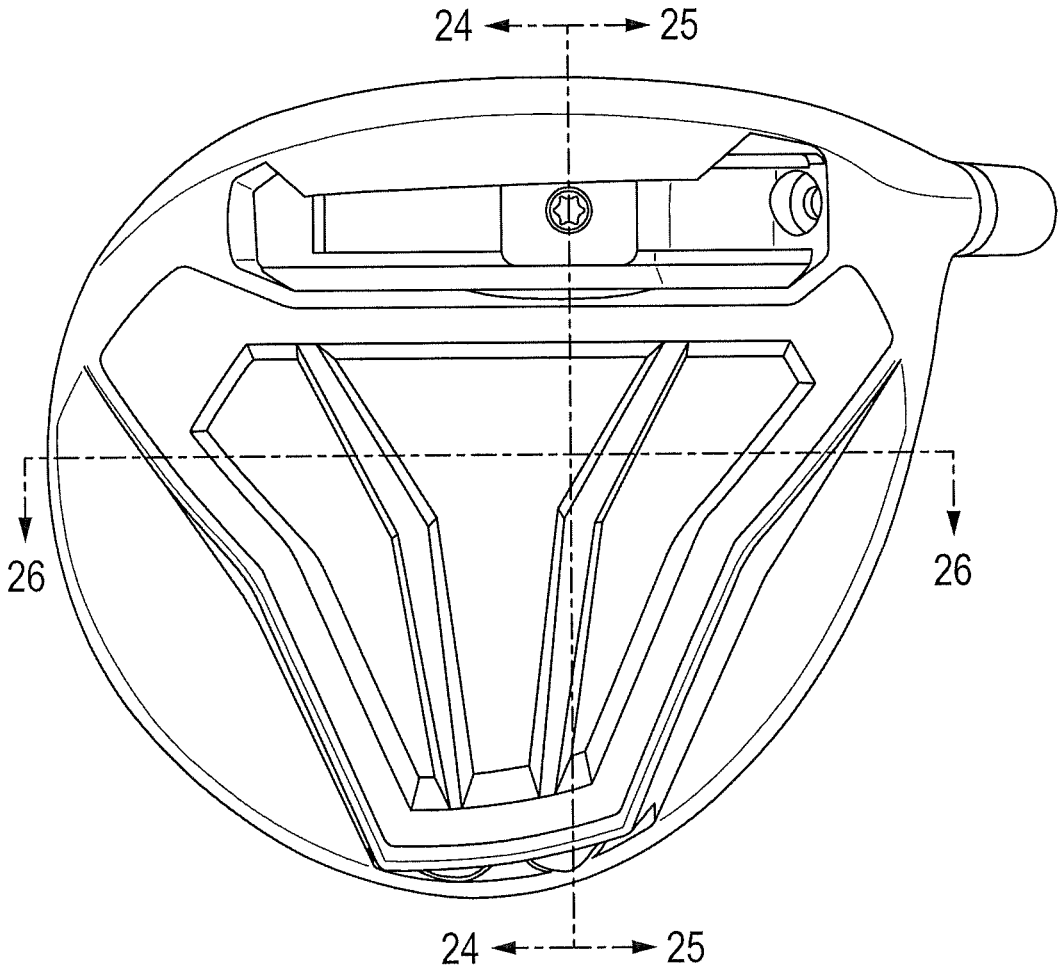
FIG. 22 is a bottom plan view of the golf club head of FIG. 21.

FIG. 22 is a bottom view of the club head's sole. The club head may include a main body or frame 424, crown insert 426 (FIG. 21), sole insert 428 and lateral weight track 430. As described above, the weight track 30 is located in the sole of the club and defines a track for mounting a two-piece slidable weight 432, which may be fastened to the weight track by a fastener such as a screw 434. The slidable weight can take other forms, such as a one-piece weight, and can be mounted in different ways. It also can be used to adjustably mount two or more slidable weights for more nuanced CG adjustments. The weight track allows the adjustable weight 432 to be loosened for adjustment laterally toward the toe or heel of the club and then tightened to adjust the effective CG of the club in the toe-heel direction. In so doing, the performance characteristics of the club can be adjusted to affect the flight of the golf ball, especially spin characteristics of the ball.

The lateral weight track 430 is very similar to the weight track discussed above. Like the weight track 36, the weight track 430 spans much of the width of the sole and allows the weight 432 to be positioned proximate to the toe of the club head at one end of the track or proximate to the heel (and hosel) at the other end of the track. Likewise, the lateral (or heel-toe) weight track also is located forward on the sole, proximate to the club head's ball-striking surface or face area 412. In modest contrast, the weight track 430 has enlarged ends at the toe side and heel side. The weight track 430 also connects with a heel-side shaft connection port used to provide a fastener opening for connecting a removable shaft and/or FCT component to the club head.

The frame 424 may be made from a variety of different types of materials but in one example is made of a metal material such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The frame may be formed by conventional casting, metal stamping or other known processes. The frame also may be made of other metals as well as non-metals. The frame provides a framework or skeleton for the club head to strengthen the club head in areas of high stress caused by the golf ball's impact with the face, such as the transition region where the club head transitions from the face to the crown area, sole area and skirt area located between the sole and crown areas.

In one exemplary embodiment, the sole insert 28 and/or crown insert 26 may be made from a variety of composite and polymeric materials, preferably from a thermoplastic material, more preferably from a thermoplastic composite laminate material, and most preferably from a thermoplastic carbon composite laminate material. For example, the composite material may be an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

Additional information regarding materials and properties suitable for the sole and crown inserts is discussed above.

As shown in FIG. 22, in one embodiment the sole insert 428 has a generally triangular shape with truncated corners, and preferably includes a recessed central area 436 and one or more ribs 438. The ribs 438, which may be located in the recessed area 436, serve to stiffen and reinforce the sole insert and thus the overall sole of the club head. In various embodiments, the sole insert covers at least about 20% of the surface area of the sole, at least about 30% of the surface area of the sole, at least about 40% of the surface area of the sole, or at least about 50% of the surface area of the sole. In another embodiment, the sole insert covers about 25 to 50% of the surface area of the sole. The sole insert contributes to a club head structure that is sufficiently strong and stiff to withstand the large dynamic loads imposed thereon, while remaining relatively lightweight to free up discretionary mass that can be allocated strategically elsewhere within the club head.

Figure 23:
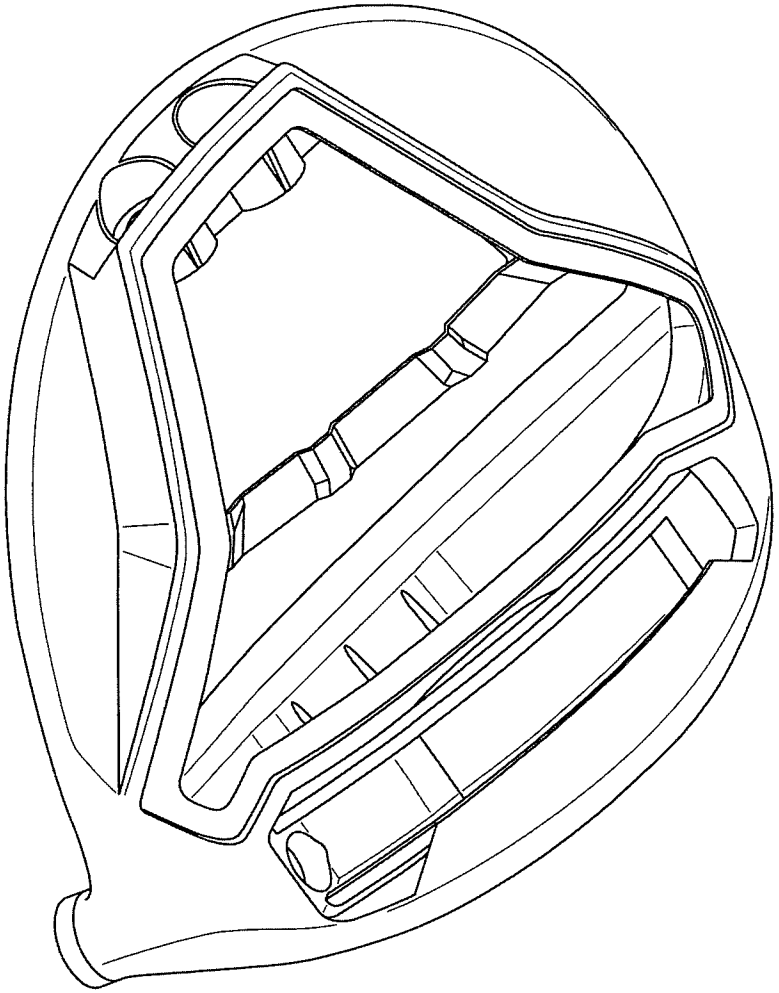
FIG. 23 is a perspective view of a sole portion of the embodiment of FIG. 21 with portions of the club head removed for purposes of illustration.

FIG. 23 is a perspective view of the club head's sole with the sole insert, crown insert and slidable weight removed. FIG. 23 shows the main body or frame 424, lateral weight track 430, hosel 420, and underside (interior surface) of a forward portion 440 of the club head's crown. It also shows in one exemplary embodiment an opening 442 in the sole to receive the sole insert, rib or tie rib 444 spanning the opening 442, and a pair of fixed weight ports 446*a*, 446*b* located at a rearmost portion of the sole. The weight ports 446*a*, 446*b* preferably are located centrally and proximate to one another, and proximate to and on opposite sides of a longitudinal center axis that generally bisects the club head into a toe half and a heel half. The weight ports 446*a*, 446*b* preferably are integrally formed as part of the main body 424, but may be formed in other ways, for example, as inserts that are secured to the main body.

The tie rib 444 preferably extends in a generally lateral heel-toe direction and is positioned generally midway between fore and aft ends of the opening 442. The tie rib 444 preferably has one or more raised portions 448 along its length, with channels or recesses therebetween, to create an undulating profile that preferably mates or nests with a complementary profile in the underside (i.e., interior) surface of the sole insert 428. The sole insert 428 preferably is adhered to the tie rib 444 and to a complementary sized and shaped recessed shelf 450 extending along the periphery of the sole insert opening 442. The sole insert may be secured to the main body 424 in other ways including the use of fasteners or other bonding techniques besides adhesion mentioned above.

Figure 24:
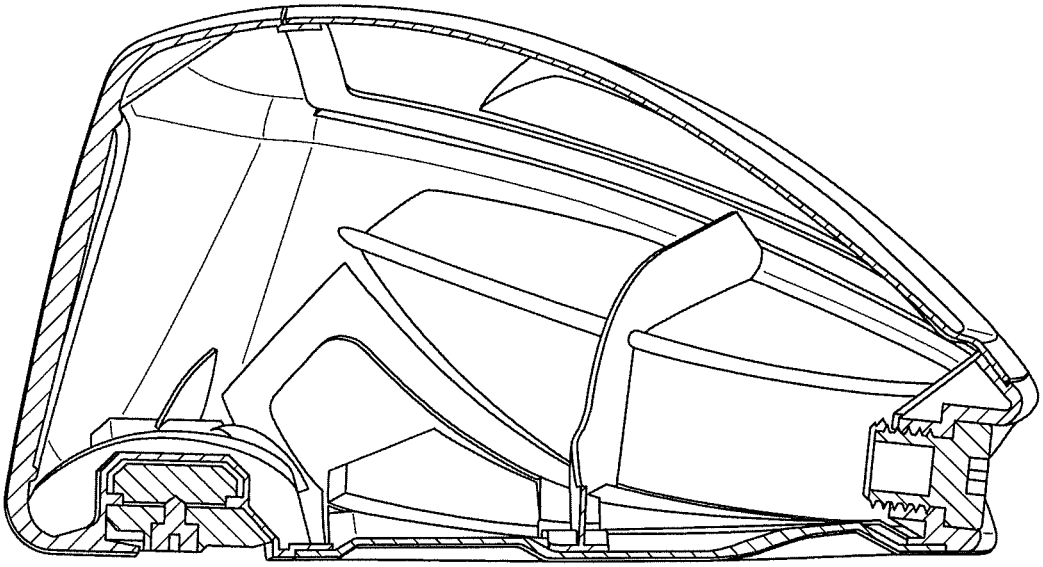
FIG. 24 is a vertical sectional view of the club head of FIG. 21 taken along line 24-24 of FIG. 22.

FIG. 24 is a vertical cross-section view along a generally centered longitudinal axis extending in the fore-aft direction. The figure shows the forward face area 412, crown insert 426, sole insert 428, lateral weight track 430, two-piece lateral weight 432, weight locking screw 434, tie rib 444, aft weight port 446, and sole insert mounting shelf 450. It also illustrates that the crown insert 426, like the sole insert, is mounted over a crown opening in the main body by securing the crown insert to a ledge or shelf 452 along the periphery of the crown opening. The crown insert 426 may be secured to the crown opening (and main body) by adhesion, like the sole insert.

A threaded weight 454 is shown threadably received in one of the fixed weight ports 446, which provides a complementary shaped threaded opening to receive the weight. Fixed weight(s) 454 may be removably fastened to the toe-side aft weight port, heel-side aft weight port, or both.

FIG. 24 also illustrates that other internal ribs, such as rib(s) 456, lateral weight track rib(s) 458 and fixed weight port rib(s) 460 may be integrally formed with or attached to the main body. Such ribs can vary in size, shape, location, number and stiffness, and used strategically to reinforce or stiffen designated areas of the main body's interior and/or fine tune acoustic properties of the club head.

Figure 25:
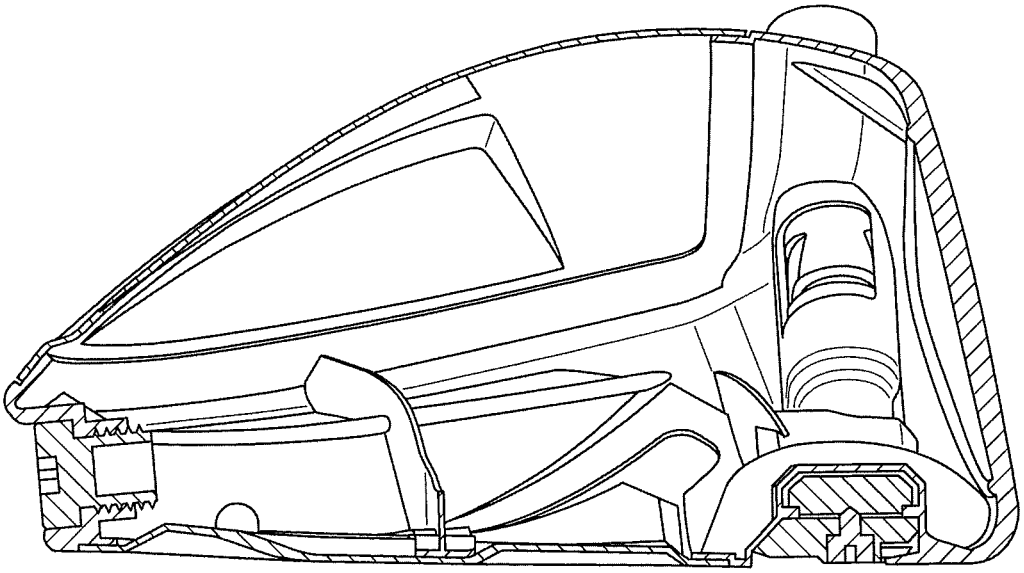
FIG. 25 is a vertical cross-section view of the club head of FIG. 21 taken along line 25-25 of FIG. 22.

FIG. 25 provides a similar vertical cross section view as FIG. 24 but looking in the opposite direction toward the heel of the club head. Unlike FIG. 24, FIG. 25 shows an adjustable FCT component or system 462 aligned with the hosel 420 to removably mount a golf shaft to the club head and permit the lie and loft of the club head to be adjusted.

Figure 26:
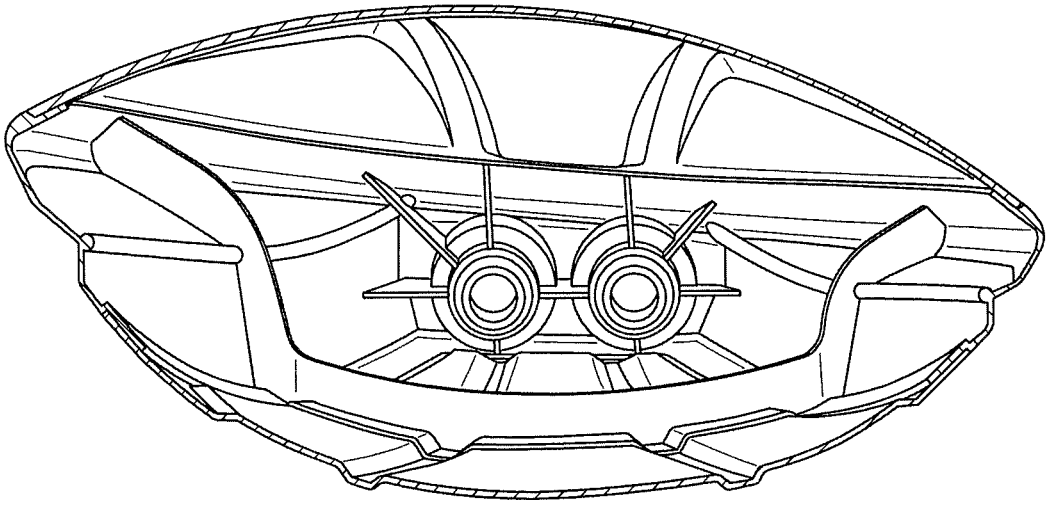
FIG. 26 is a vertical cross-section view of the club head of FIG. 21 taken along line 26-26 of FIG. 22.

FIG. 26 is a vertical section view taken along a lateral axis located generally mid-way between the forward face 412 and rearmost portion of the club head. It illustrates that a cross rib 464 may laterally span the interior of the club head and join opposing side ribs 456. It further illustrates how the raised portions 448 of the tie rib 444 mate with interior channels formed in the sole insert 428. The exterior of these interior channels can be seen as outer ribs 438 in FIGS. 22 and 26.

As shown in Table 2 below, one or more embodiments of the present disclosure are able to achieve high MOI (Ixx and Izz), relatively low CG ($CG_z$) and a desirable Center of Gravity projection on the club face, also known as "balance point on the face" (BP Proj.). "Front d mass" denotes the mass of the slidable weight 432 in the lateral weight track 430. For example, the front slidable weight may be 10 g, 20 g or 15 g, as well as other values. "Back d mass" denotes the mass of the fixed aft weight(s), and includes the combined mass of weights in both weight ports 446*a, b* if two weights are installed. The back d mass (one or two weights), for example, may be 20 g, 10 g, 15 g or some other value. CGx and CGz represent center of gravity locations on the x and z coordinate axes, respectively.

Delta 1 (D1) represents the distance between the club head's CG and its hosel axis along the Y axis (in a direction straight toward the back of the body of the club head face from the geometric center of the face). Thus, for embodiments disclosed herein in which the projected CG (BP Proj.) on the ball striking face is lower than the geometric center, reducing Delta 1 produces a lower projected CG and a lower dynamic loft and creates a desirable further reduction in backspin due to the Z-axis gear effect. Thus, the embodiment of FIGS. 21-26 (and other embodiments disclosed herein) facilitate a club design having a desirable high launch angle and yet relatively low spin rate. High launch trajectories are normally associated with higher spin rates.

"Mass" denotes the mass of the club head in grams. Ixx and Izz denote the moment of inertia of the club head about the x and z axes, respectively.

The values in Table 2 below represent club heads having a composite crown/composite sole and volume of about 460 $cm^3$.

TABLE 2

| Front dMass | Back dMass | CGx (mm) | CGz (mm) | D1 (mm) | Mass (g) | IXX $g \cdot mm^2$ | IZZ $g \cdot mm^2$ | BP Proj (mm) |
|---|---|---|---|---|---|---|---|---|
| 10 g | 20 g | 0.7 | −4.8 | 25.5 | 205.2 | 390 | 532 | 2.2 |
| 20 g | 10 g | 0.9 | −5.2 | 18.9 | 205.2 | 344 | 484 | 1 |
| 15 g | 15 g | 1.1 | −5.1 | 23.1 | 205.2 | 370 | 510 | 1.6 |

In this instance the foregoing properties and values are achieved with a laterally adjustable, forward-located weight and a pair of fixed weight ports located centrally and rearwardly on the club head, both of which may be integrally formed and cast as part of the main body or frame. The foregoing properties and values may also be achieved with relatively light polymer (or composite) sole and crown inserts.

A method of making a golf club may include one or more of the following steps:

- forming a frame having a sole opening, forming a composite laminate sole insert, injection molding a thermoplastic composite head component over the sole insert to create a sole insert unit, and joining the sole insert unit to the frame;
- providing a composite head component which is a weight track capable of supporting one or more slidable weights;
- forming the sole insert from a thermoplastic composite material having a matrix compatible for bonding with the weight track;
- forming the sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof;
- forming both the sole insert and weight track from thermoplastic composite materials having a compatible matrix;
- forming the sole insert from a thermosetting material, coating the sole insert with a heat activated adhesive, and forming the weight track from a thermoplastic material capable of being injection molded over the sole insert after the coating step;
- forming the frame from a material selected from the group consisting of titanium, one or more titanium alloys, aluminum, one or more aluminum alloys, steel, one or more steel alloys, and any combination thereof;
- forming the frame with a crown opening, forming a crown insert from a composite laminate material, and joining the crown insert to the frame such that the crown insert overlies the crown opening;
- selecting a composite head component from the group consisting of one or more ribs to reinforce the head, one or more ribs to tune acoustic properties of the head, one or more weight ports to receive a fixed weight in a sole portion of the club head, one or more weight tracks to receive a slidable weight, and combinations thereof;
- forming the sole insert and crown insert from a continuous carbon fiber composite material;
- forming the sole insert and crown insert by thermosetting using materials suitable for thermosetting, and coating the sole insert with a heat activated adhesive;
- forming the frame from titanium, titanium alloy or a combination thereof and has a crown opening, and the sole insert and weight track are each formed from a thermoplastic carbon fiber material having a matrix selected from the group consisting of polyphenylene sulfide (PPS), polyamides, polypropylene, thermoplastic polyurethanes, thermoplastic polyureas, polyamide-amides (PAD, polyether amides (PEI), polyetheretherketones (PEEK), and any combinations thereof; and
- forming the frame with a crown opening, forming a crown insert from a thermoplastic composite material, and joining the crown insert to the frame such that it overlies the crown opening.

In certain implementations of foregoing and later embodiments disclosed herein, the golf club head 10, 100, 300, 400, etc., may include alternative slidable weight features similar to those described in more detail in U.S. Pat. Nos. 7,775,905 and 8,444,505; 8,734,271 filed on May 20, 2013; U.S. Pat. No. 8,870,678, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

The metal wood club head 10, 100, 300, 400, etc. of foregoing and later embodiments disclosed herein has a volume, typically measured in cubic-centimeters ($cm^3$), equal to the volumetric displacement of the club head 10, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports. In several embodiments, a golf club head of the present application can be configured to have a head volume between about 110 $cm^3$ and about 600 $cm^3$. In more particular embodiments, the head volume is between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 360 $cm^3$ and about 420 $cm^3$ or between about 420 $cm^3$ and about 500 $cm^3$.

In the case of a driver, the golf club head may have a volume between about 300 $cm^3$ and about 460 $cm^3$, and a total mass between about 145 g and about 245 g. In the case of a fairway wood, the golf club head may have a volume between about 100 $cm^3$ and about 250 $cm^3$, and a total mass between about 145 g and about 260 g. In the case of a utility or hybrid club the golf club head 10 may have a volume between about 60 $cm^3$ and about 150 $cm^3$, and a total mass between about 145 g and about 280 g.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-$SO_2$-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

The three must commercially important polysulfones are;

a) polysulfone (PSU);

b) Polyethersulfone (PES also referred to as PESU); and c) Polyphenylene sulfoner (PPSU)

Particularly important and preferred aromatic polysulfones are those comprised of repeating units of the structure —$C_6H_4SO_2$—$C_6H_4$—O— where $C_6H_4$ represents a m- or p-phenylene structure. The polymer chain can also comprise repeating units such as —$C_6H_4$—, $C_6H_4$—O—, —$C_6H_4$-(lower-alkylene)-$C_6H_4$—O—, —$C_6H_4$—O—$C_6H_4$—O—, —$C_6H_4$—S—$C_6H_4$—O—, and other thermally stable substantially-aromatic difunctional groups known in the art of engineering thermoplastics. Also included are the so called modified polysulfones where the individual aromatic rings are further substituted in one or substituents including

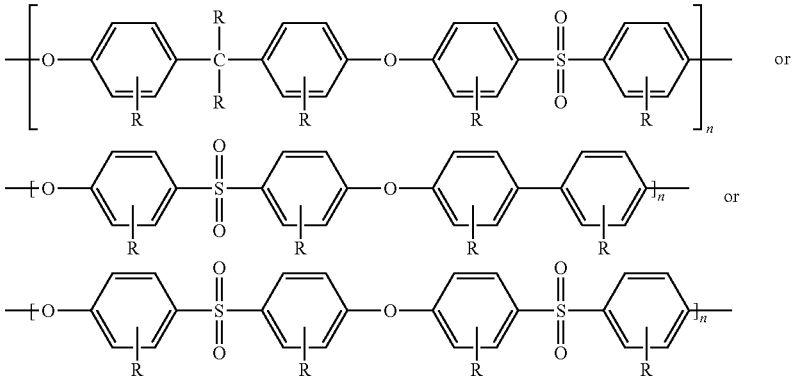

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a $C_1$-$C_{20}$ alkyl group, a $C_2$-$C_{20}$ alkenyl group, a $C_3$-$C_{20}$ cycloalkyl group, a $C_3$-$C_{20}$ cycloalkenyl group, and a $C_6$-$C_{20}$ aromatic hydrocarbon group. These hydrocarbon groups may be partly substituted by a halogen atom or atoms, or may be partly substituted by a polar group or groups other than the halogen atom or atoms. As specific examples of the $C_1$-$C_{20}$ alkyl group, there can be mentioned methyl, ethyl, propyl, isopropyl, amyl, hexyl, octyl, decyl and dodecyl groups. As specific examples of the $C_2$-$C_{20}$ alkenyl group, there can be mentioned propenyl, isopropepyl, butenyl, isobutenyl, pentenyl and hexenyl groups. As specific examples of the $C_3$-$C_{20}$ cycloalkyl group, there can be mentioned cyclopentyl and cyclohexyl groups. As specific examples of the $C_3$-$C_{20}$ cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers, include, (a) the polysulfone made by condensation polymerization of bisphenol A and 4,4'-dichlorodiphenyl sulfone in the presence of base, and having the main repeating structure

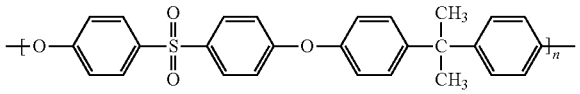

having the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

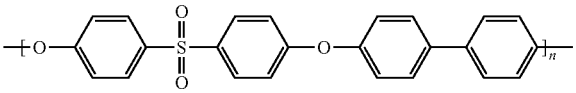

having the abbreviation PPSF and sold under the tradenames RADEL® resin; and (c) a condensation polymer made from 4,4'-dichlorodiphenyl sulfone in the presence of base and having the principle repeating structure

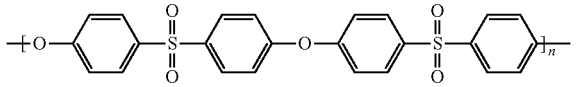

having the abbreviation PPSF and sometimes called a "polyether sulfone" and sold under the tradenames Ultrason® E, LNP™, Veradel®PESU, Sumikaexce, and VICTREX® resin, ".and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred is a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also preferred is a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Also preferred is a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

Figure 27:
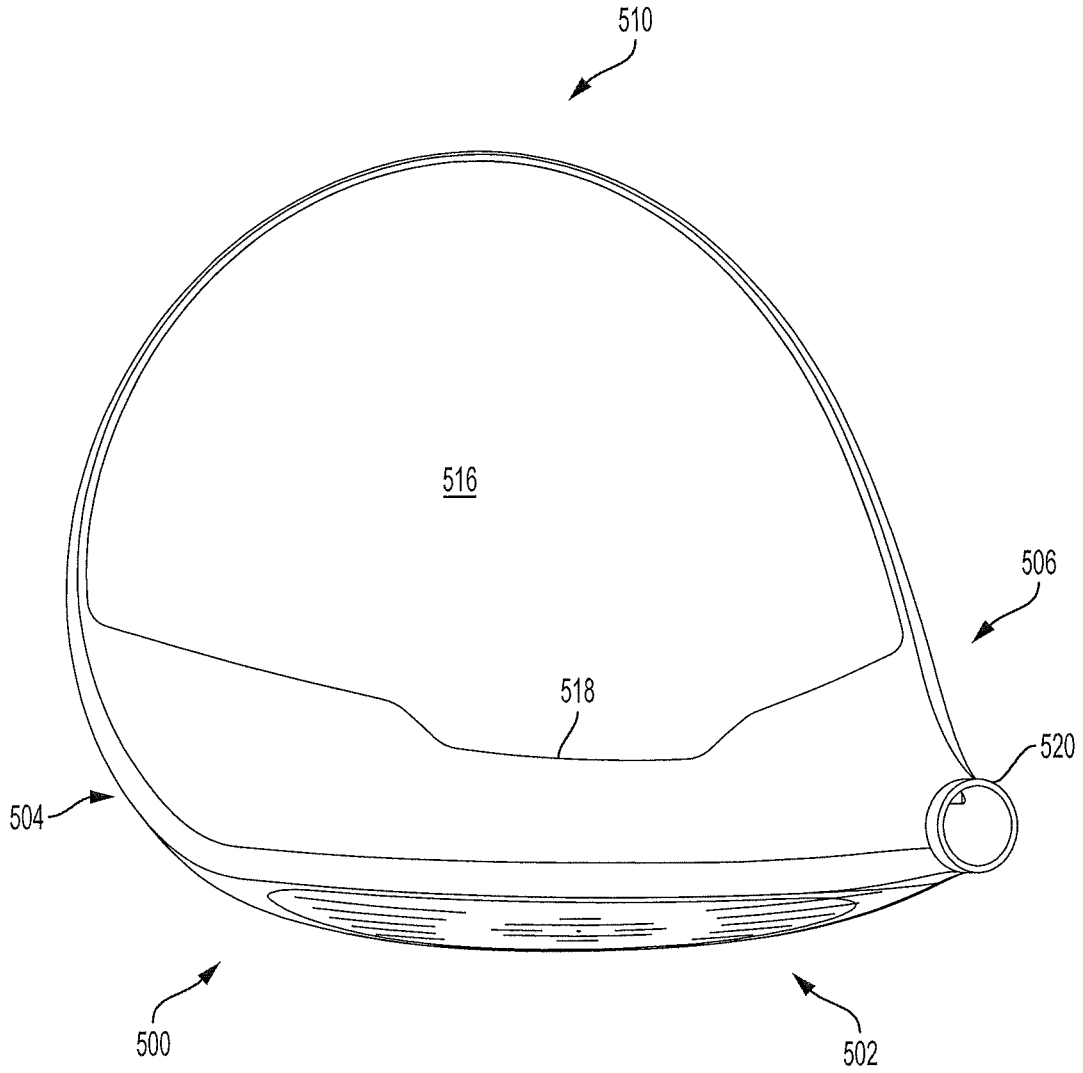
FIG. 27 is a top plan view of a golf club head in accordance with another embodiment.
Figure 28:
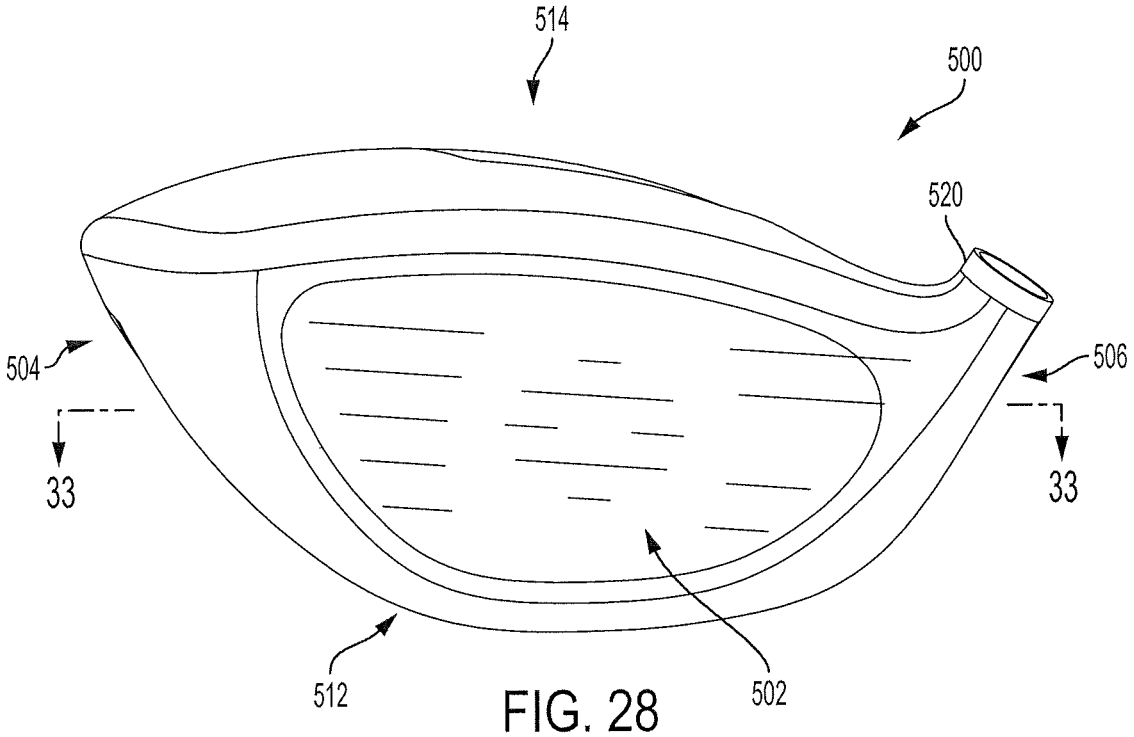
FIG. 28 is a front elevation view of the head of FIG. 27.

An additional embodiment of a golf club head 500 is shown in FIGS. 27-36. Referring to FIGS. 27, 28, the head 500 includes a forward face 502, toe 504, heel 506 opposite the toe 504, and a rear or aft section 510 opposite the face 502. The head also includes a sole 512 at the bottom of the club head and crown 514 at the top, which create a surface area expanse between the toe, heel, face and aft section to form a golf club head having a generally hollow interior. The embodiment described in FIGS. 27-36 is well-suited for metal-wood type club heads, especially driver-type club heads, having a hollow interior. The volume of the club head 500 is in the range previously described and, for example, one preferred driver-type head may have a volume typical of metal-wood drivers, such as between about 420 $cm^3$ to 500 $cm^3$.

FIG. 27 further illustrates that the crown 514 includes a crown insert 516, which preferably covers a substantial portion of the crown's surface area as, for example, at least 40%, at least 60%, at least 70% or at least 80% of the crown's surface area. The crown's outer boundary generally terminates where the crown surface undergoes a significant change in radius of curvature as it transitions to the head's sole or face. In one example, the crown insert 516 is set back from the face 502 and has a forwardmost edge that generally extends between the toe and heel and defines a centrally located notch 518 which protrudes toward the face 502. The head further includes a hosel 520 on the heel side to which a golf shaft may be attached.

Figure 29:
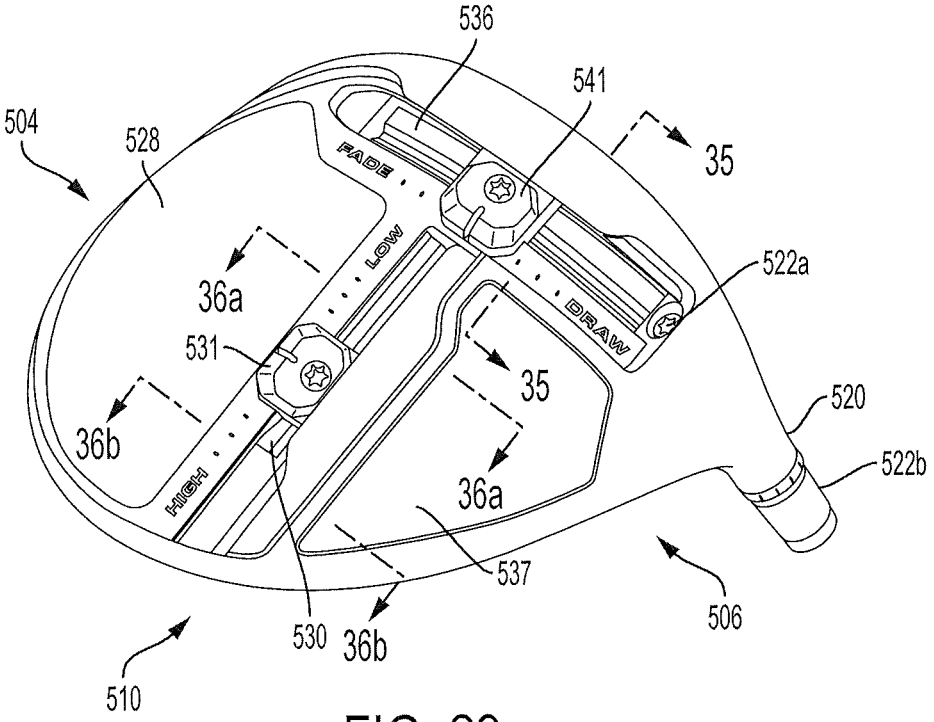
FIG. 29 is a bottom perspective view of the head of FIG. 27.

The bottom perspective view of FIG. 29 shows the head in one example having an adjustable FCT component 522*a*, 522*b*, as previously described, front-to-back weight track 530, and lateral weight track 536. The weight tracks 530, 536 preferably are an integral part of the frame formed by casting, metal stamping, or other known processes as described above with respect to the frame 24. The frame may be made from materials also described above with reference to frame 24 and other embodiments, but in one preferred embodiment is made from a metal material or other material which provides a strong framework for the club head in areas of high stress. In contrast with the FIG. 2 embodiment, FIG. 29 illustrates that the sole has a heel-side portion 537 on the heel side of weight track 30 which is an integral (preferably cast) part of the frame.

As described above, the lateral weight track 536 defines a track proximate and generally parallel to the face 502 for mounting one or more one-piece or multi-piece slidable weights 541. The weight(s) may be laterally adjusted in the heel-toe direction to modify the performance characteristics of the head as previously described. Similarly, the weight track 530 defines a front-to-back weight track for mounting one or more one-piece or multi-piece slidable weight(s) 531. The weight(s) 531 may be slidably adjusted fore and aft to shift the CG of the club head in the front-to-rear direction, as previously described, and thereby modify the performance characteristics of the head (especially spin characteristics and height of golf balls launched by the head). FIG. 29 also illustrates that the sole 512 includes a sole insert 528 located on a toe-side of the sole and one side of the weight track 530. The sole insert 528 (as well as the crown insert 516) may be made from a lightweight material as, for example, one of the polymers described above and in one preferred example one of the polysulfone compositions. The sole insert covers a portion of the sole's surface area as, for example, at least 10%, at least 20%, at least 40% or at least 50% of the total sole surface area, and is located entirely on one side of the weight track 530.

Figure 30:
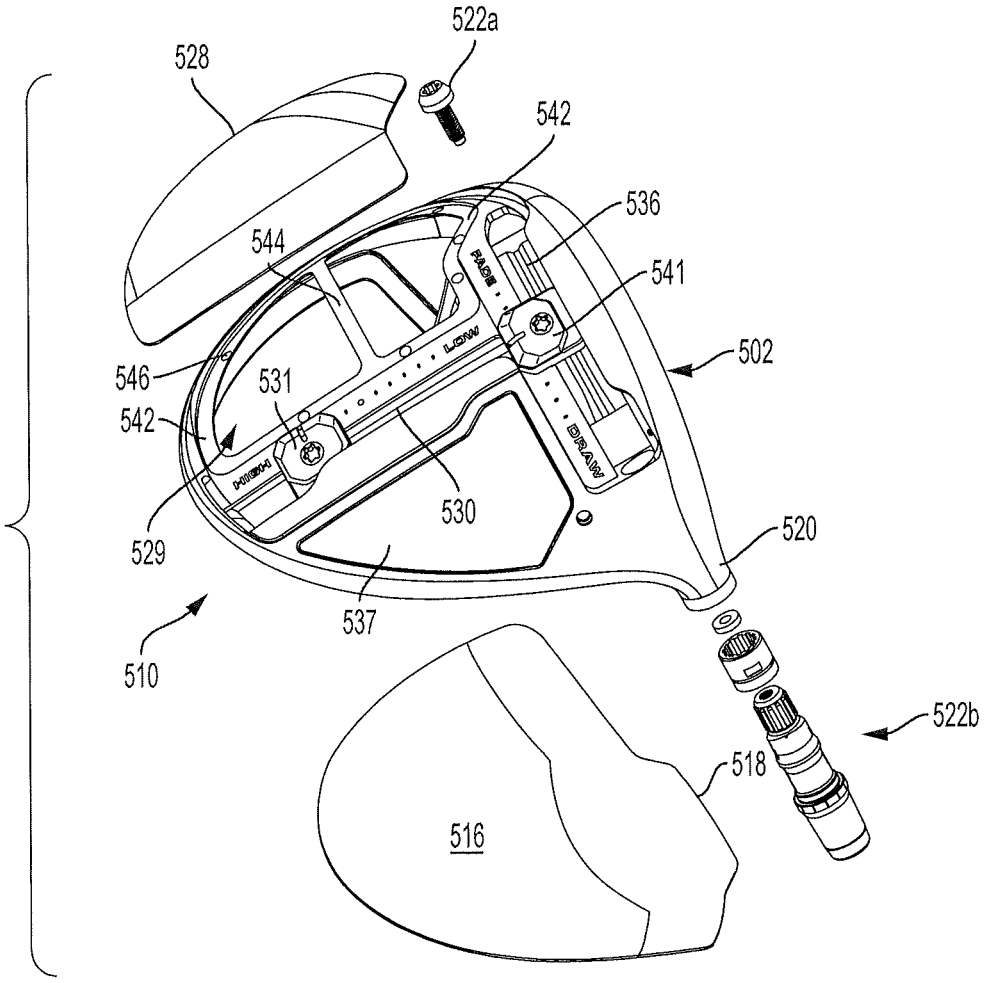
FIG. 30 is a bottom perspective exploded view of the head of FIG. 27.

FIG. 30 is an exploded view of the head 500 showing the crown insert 516 and sole insert 528 separated from the frame of the head. The frame provides an opening 529 in the sole which reduces the mass of the head's frame or skeletal support structure. The frame includes a recessed ledge 542 along the periphery of the opening 529, and cross-support 544 to seat and support the sole insert 528. The sole insert 528 has a geometry and size compatible with the opening 529, and is secured to the frame by adhesion or other secure fastening technique so as to cover the opening 529. The ledge 542 may be provided with indentations 546 along its length to receive matching protrusions or bumps on the underside of the sole insert 528 to further secure and align the sole insert on the frame.

FIG. 30 provides a more detailed illustration of FCT component 522*b*, which is secured to the hosel 520 by FCT component 522*a*. Component 522*b* mounts the golf shaft to the head and may be adjustably rotated to change the orientation of the club head relative to a standard address position of the golf shaft.

Figure 31:
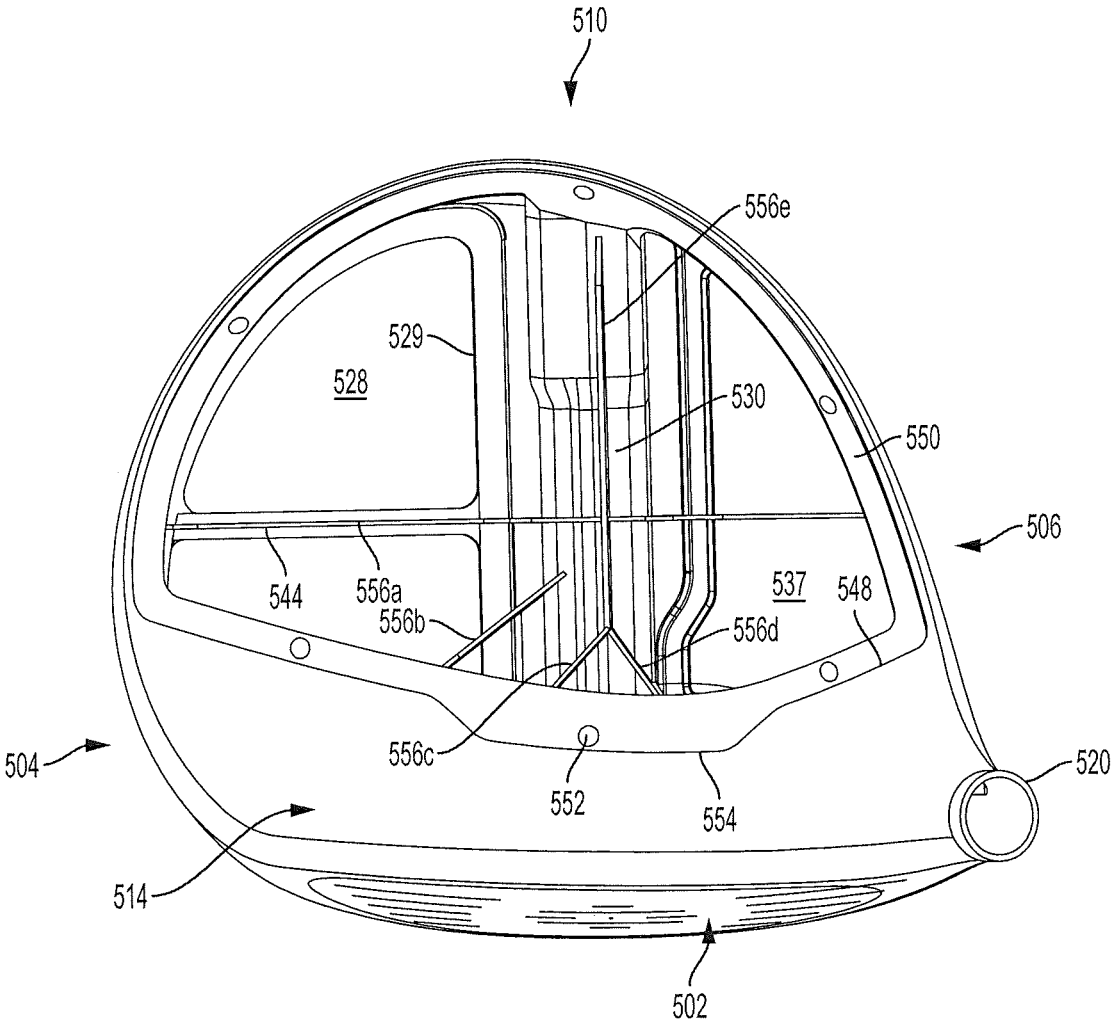
FIG. 31 is a top plan view of the head of FIG. 27 with a crown insert removed.

FIG. 31 is a top plan view of the head with the crown insert 516 removed, revealing internal structural elements of the head and its frame. Like the sole, the crown also has an opening 548 which reduces the mass of the frame, and more significantly, reduces the mass of the crown, a region of the head where increased mass has the greatest impact on raising (undesirably) the CG of the head. Along the periphery of the opening 548, the frame includes a recessed ledge 550 to seat and support the crown insert 516. The crown insert 516 (not shown in FIG. 31) has a geometry and size compatible with the crown opening 548 and is secured to the frame by adhesion or other secure fastening technique so as to cover the opening 548. The ledge 550 may be provided with indentations 552 along its length to receive matching protrusions or bumps on the underside of the crown insert to further secure and align the crown insert on the frame. As with the sole insert, the ledge 550 alternately may be provided with protrusions to match indentations provided on the crown insert.

The periphery of opening 548 is proximate to and closely tracks the periphery of the crown on the toe-, aft-, and heel-sides of the head. The face-side of the opening 548 preferably is spaced farther from the face 502 (i.e., forward-most region of the head) than the heel-, toe- and aft-sides of the opening are spaced from the skirt of the head. In this way, the head has additional frame mass and reinforcement in the crown area just rearward of the face 502. This area and other areas adjacent to the face along the toe, heel and sole support the face and are subject to the highest impact loads and stresses due to ball strikes on the face. As previously described, the frame may be made of a wide range of materials, including high strength titanium, titanium alloys, or other metals.

The opening 548 has a notch 554 which matingly corresponds to the crown insert notch 518 to help align and seat the crown insert on the crown.

FIG. 31 also illustrates sole insert opening 529, interior surface of sole insert 528, cross support 544, interior surface of front-to-back weight track 530, and interior surface of the heel-side sole portion 537. Various ribs 556*a, b, c, d, e, f* are shown located in the interior of the head to provide structural reinforcement and acoustic-modifying elements.

Figure 32:
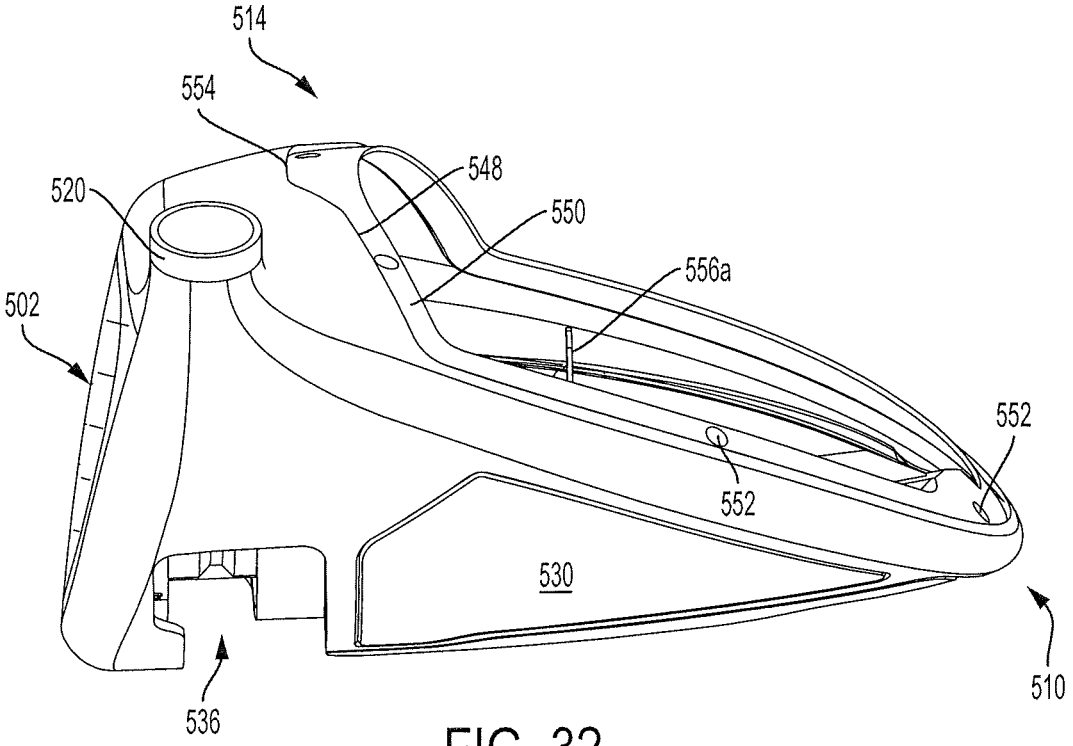
FIG. 32 is a side elevation view of the head of FIG. 27 with the crown insert removed.

FIG. 32 is a side elevation view with the crown insert removed. It illustrates how the sole wraps upon the heel-side of the head to meet the crown 514 at the skirt interface between the sole and crown. The crown opening 548 is shown encompassing a substantial portion of the surface area of the crown, such as well over 50% of the crown's surface area in the illustrated example.

Figure 33:
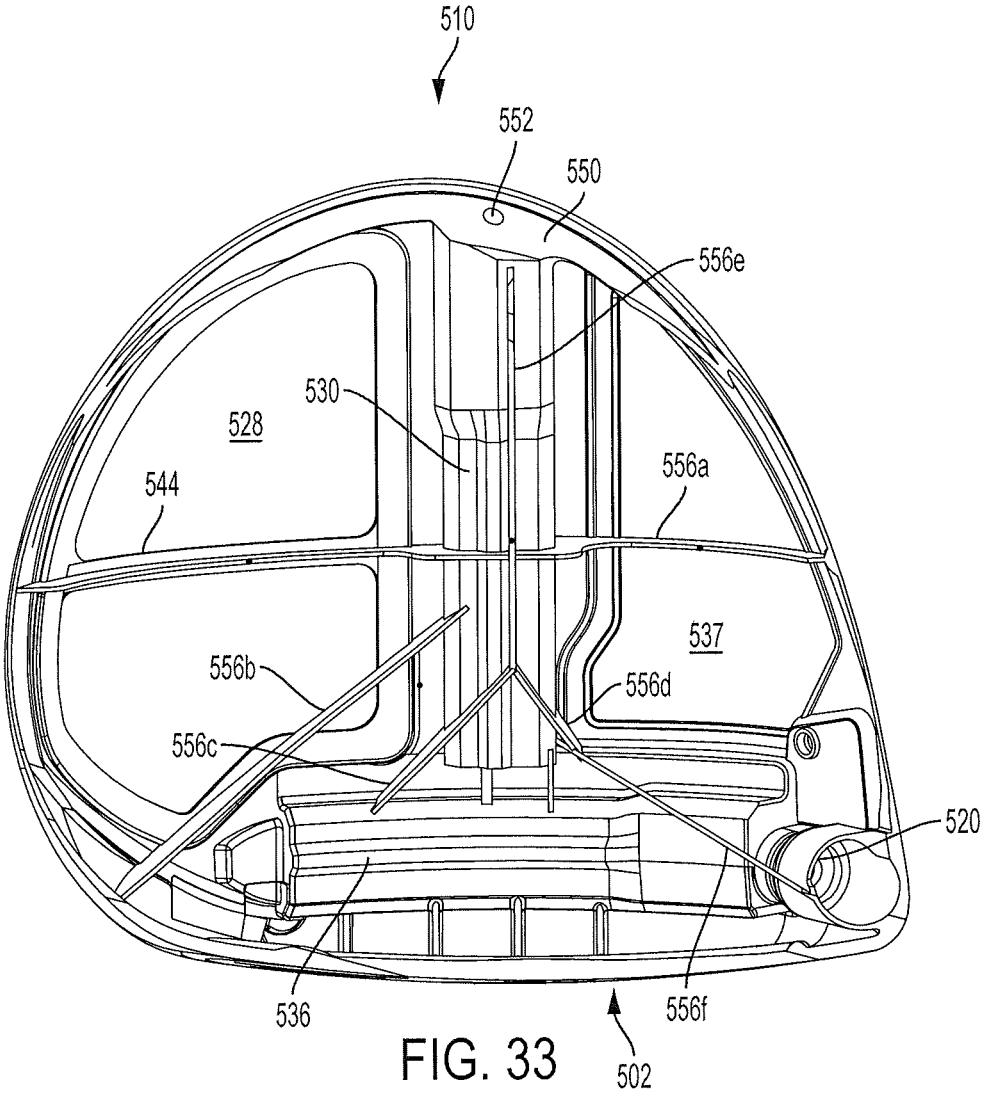
FIG. 33 is a horizontal cross-section view taken along line 33-33 of FIG. 28.

FIG. 33 is a horizontal cross-section of the club, below the level of the crown, showing some of the internal structure apparent in FIG. 31 but in more detail. Cross rib 556 spans the internal width of the head from toe to heel and braces weight track 530. Rib 556*e* extends in the fore-to-aft direction and is secured to a top interior surface of weight track 530. Diagonal ribs 556*c, d* are secured at opposite ends to the weight tracks 530, 536. An additional rib 556*f* is shown joined to the hosel 520 at one end and to the weight track 530 at the other end.

Figure 34:
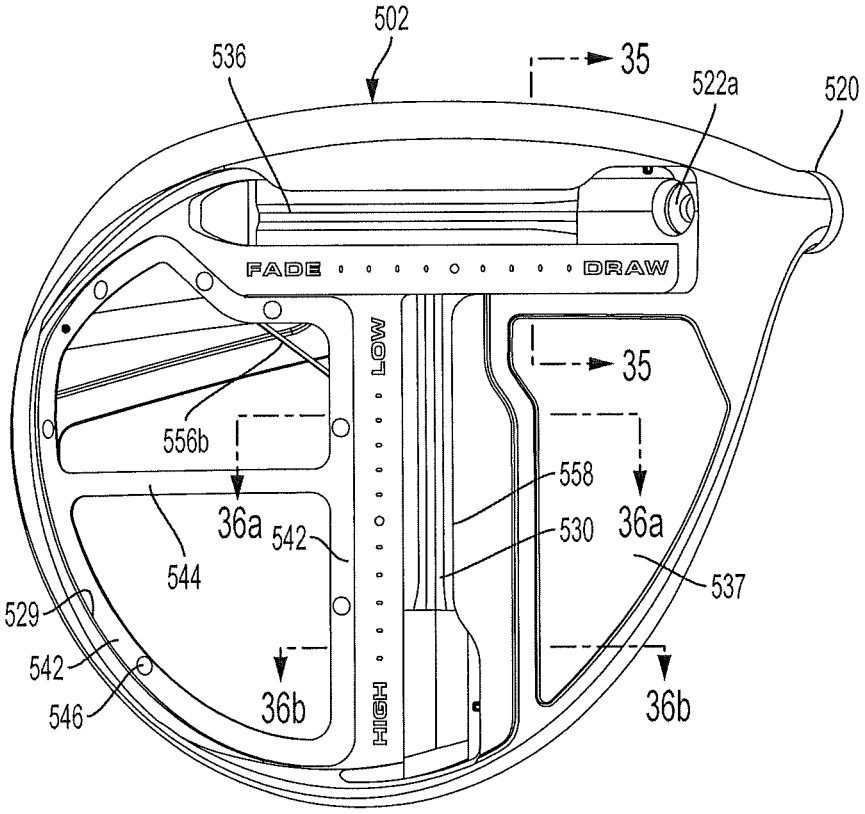
FIG. 34 is a bottom plan view of the head of FIG. 27, with a sole insert panel removed.

FIG. 34 is a bottom plan view of the head with the sole insert removed. With reference to FIGS. 29 and 34, and explained further below, the sole of the present embodiment is a two tier or drop sole construction, in which one portion of the sole is dropped or raised, depending on perspective, relative to the other portion of the sole. The sole insert 528 on the toe-side of the weight track 530 is raised (when the club head is in the address position) relative to the heel-side portion 537 of the sole. The heel-side portion 537 also can be considered a drop sole part of the sole, since it is dropped or closer to the ground when the club head is in the address position. The heel-side portion 537 has an edge or portion 558 which extends over or overhangs a portion of the weight track 530. Though the front-to-back weight(s) are not shown in FIG. 34, it will be appreciated that the overhang portion 558 helps to capture the weight(s) in the weight track 530 by providing a narrow opening or channel through which the weights may be inserted into or removed from the weight track. At the same time, the weight(s) are free to be slidably moved and re-set in the weight track by loosening and then tightening the adjustment screw (see FIG. 29) which secures the weight(s) to the weight track.

Figure 35:
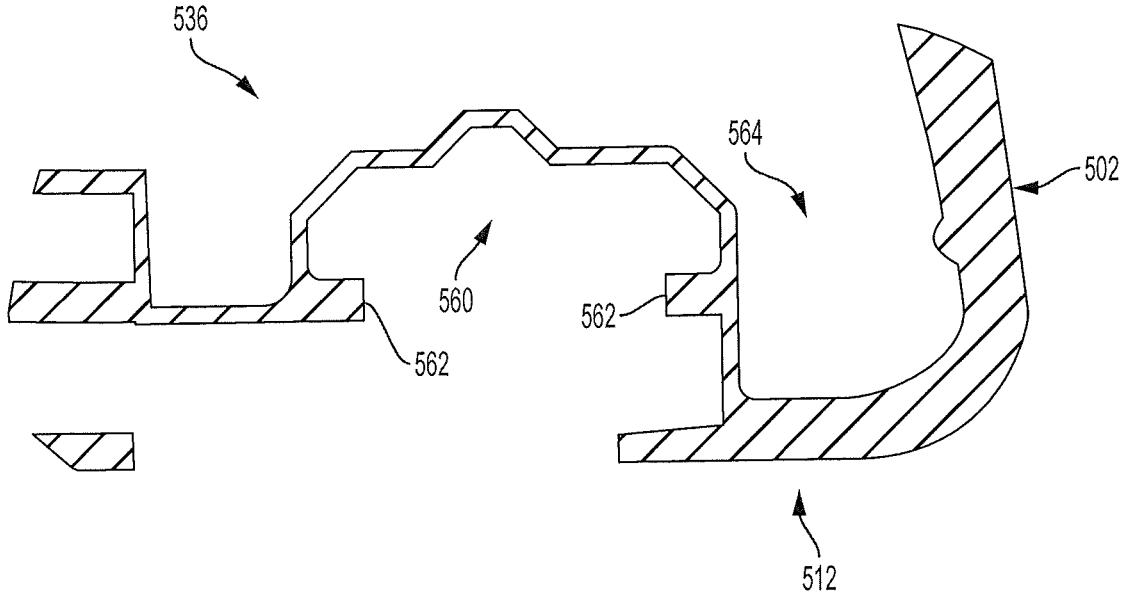
FIG. 35 is an enlarged detail cross-section view of a side-to-side weight track taken generally along line 35-35 of FIG. 34.

FIG. 35 is a fore-aft vertical cross-section of lateral weight track 536 taken along line 35-35 of FIG. 34. The weight track 536 includes a laterally (heel-toe) extending channel 560 to receive one or more compatibly shaped one-piece or multi-piece weights (not shown) for adjustable sliding movement in the heel-toe direction. Opposing rails or lips 562 help retain the weight(s) in the channel. The weight track extends generally parallel and proximate to the face 502 but preferably is set back from the face by a laterally extending recess 564.

Figure 36A:
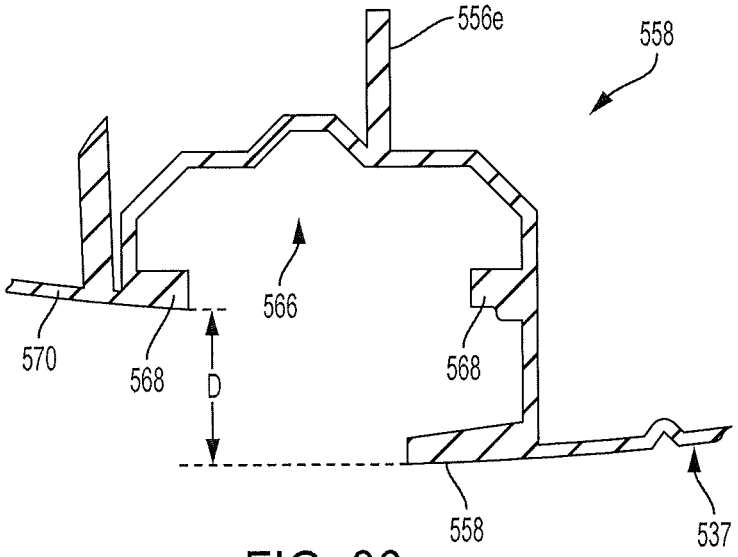
FIGS. 36*a*, 36*b* are enlarged, detail cross-section views taken along lines 36*a*-36*a* and 36*b*-36*b* of FIG. 34.
Figure 36B:
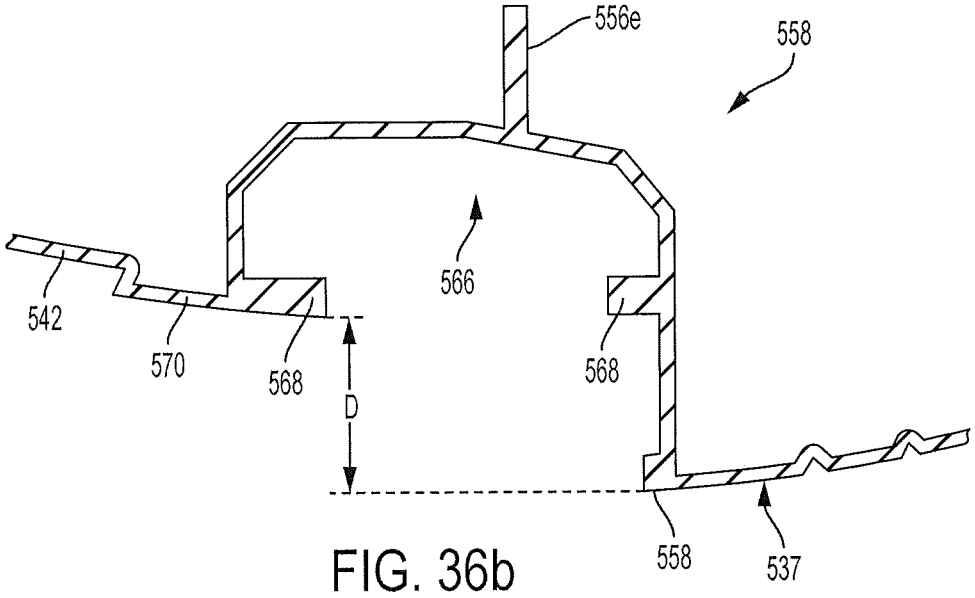

FIGS. 36*a*, 36*b* are lateral cross-sections of fore-aft weight track 558 taken along different vertical planes, represented by lines 36*a*-36*a* and 36*b*-36*b* in FIG. 34. The weight track 558 includes a fore-aft (or front-rear) extending channel 566 to receive one or more compatibly shaped one-piece or multi-piece weights (not shown) for adjustable sliding movement in the fore-aft or front-back direction. Like track 536, the track 558 includes opposing rails or lips 568 to retain and guide the weights (when adjusted) in the channel. In this regard, each weight has portions (in a one-piece construction) or different pieces (in a multi-piece weight) seated on each side of the rails 568. Thus, the rails retain or seat the weight(s) while allowing the weight(s) to slide within the track when a securing fastener is loosened.

In FIG. 36*a* it can be seen that the overhang portion 558 of the heel-side sole portion 537 extends over or overhangs the channel 566 to restrict the mouth of the channel and help retain the weight(s) within the channel FIGS. 34 and 36*b* illustrate that the overhang portion 558 tapers or narrows as it approaches the aft portion of the sole, such that the heel-side sole portion's amount of overhang or cantilevering over the channel 566 is much smaller than is the case in FIG. 36*a* (where the channel 566 is closer to the face).

The head's sole has a centrally-located fore-aft extending section 570 adjacent the weight track 558, which may be marked with weight track indicia (such as "high" to "low" ball flight) as shown in FIG. 34. The section 570 may sit flush with the sole insert 528 and be formed as an integral part of of the head frame. As shown in FIG. 36*b*, the sole section 570 terminates at the sole insert receiving ledge 542.

Referring to FIGS. 36*a*, 36*b*, the sole area on the heel side (represented by heel-side sole portion 537) is lower than the sole area on the toe side (represented by section 570 and sole insert 528 (FIG. 29)) by a distance "D" when the head is in the address position relative to a ground plane. The head has a "drop sole" construction with a portion of the sole dropped (preferably on the heel side) relative to another portion of the sole (preferably on the toe side). Put another way, a portion of the sole (e.g., toe side) is raised relative to another portion of the sole (e.g., heel side).

In one embodiment, the drop distance "D" may be in the range of about 2-12 mm, preferably about 3-9 mm, more preferably about 4-7 mm, and most preferably about 4.5-6.5 mm. In one example, the drop distance "D" is about 5.5 mm.

The bi-level or drop sole described is counterintuitive because the raised portion of the sole is tends to raise the CG of the club, which generally is disadvantageous. However, by using a sole insert made of a relatively light material such as composite material or other polymeric material (polysulfone for example), the higher CG effect is mitigated while maintaining a stronger, heavier material on the heel side of the sole to promote a lower CG and provide added strength in the area of the sole where it is most needed (i.e., in a sole region proximate to the hosel, shaft connection and FCT components where stress is high). Additionally, the drop sole allows for a smaller radius for a portion of the sole resulting in better acoustic properties due to the increased stiffness from the geometry. This stiffness increase means less ribs or even no ribs are needed to achieve a first mode frequency at 3400 Hz or above. Less ribs provides a weight savings which allows for more discretionary mass that can be strategically placed elsewhere in the club head or incorporated into a user adjustable movable weight.

Figure 37:
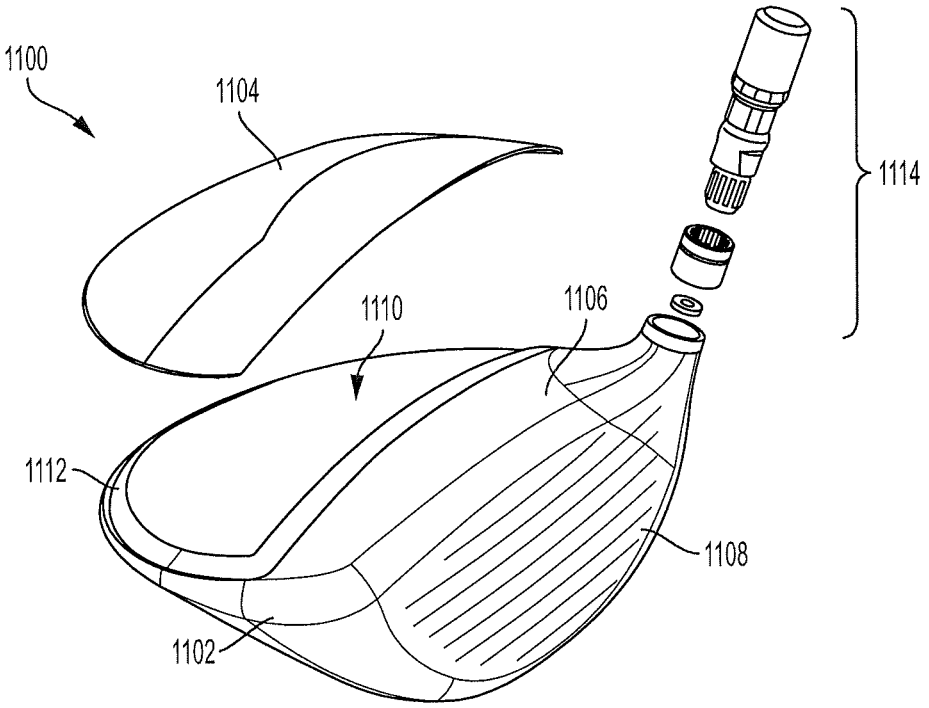
FIG. 37 illustrates an exploded perspective view of a conventional golf club head including a main body and a crown plate.

FIG. 37 shows an exploded view of an exemplary conventional golf club head 1100 having a main body 1102 and a crown plate 1104 configured to be attached to top surface 1106 of the main body 1104 of the golf club head 1100. The main body 1102 further includes a striking surface or face 1108, a cast opening 1110 and a flange 1112 that forms a recessed ledge along the periphery of the cast opening 1110. The golf club head 1100 further includes a hosel structure 1114 configured to couple the golf club head 1100 to a shaft (not shown). As shown in the illustrated embodiment of FIG. 37, the flange 1112 provides a step down ledge from the top surface 1106 of the main body 1102 and is configured to support a peripheral edge of the crown plate 1104 when the crown plate 1104 is placed within the cast opening 1110 to cover and seal the opening 1110.

In accordance with various embodiments, the golf club head 1100 can further include one or more adjustable weight features in a sole portion (not shown) opposite the top surface 106, and/or additional features, as described in U.S. Pat. Nos. 6,878,078 and 8,888,607, and U.S. application Ser. No. 14/789,838, entitled "Golf Club Head," filed on Jul. 1, 2015, and U.S. application Ser. No. 14/855,190, entitled "Golf Club Heads," filed on Sep. 15, 2015, each of which are incorporated herein by reference in their entireties.

Generally, a lightweight material (e.g., a composite material) is selected to form the crown plate 1104, which is different from a material (e.g., a metal material) used to form the main body 1102 of the golf club head 1100. For example, the main body 1102 may be made from titanium or steel alloy and the crown plate 1104 may be made from a composite material such as a carbon fiber or graphite material. Carbon fiber and graphite composites typically have a density of about 1.5 g/cm$^3$, compared to titanium alloy which typically has a density of about 4.5 g/cm$^3$. Thus, the ability to manufacture a golf club head using a combination of titanium alloy and carbon fiber, for example, offers a wide range of possibilities for varying the mass of the club head, as well as distributing the mass within the club head. For example, considerable weight savings may be achieved by making, at least, the crown and/or other components (e.g., a sole, and/or a face plate) of the golf club head 1100 from one or more light-weight composite materials.

Figure 38:
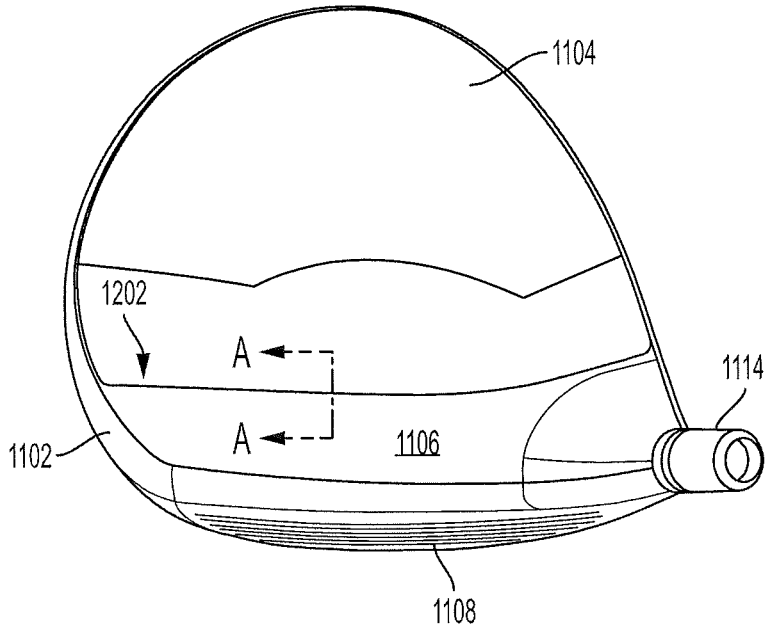
FIG. 38 illustrates a top view of the conventional golf club head of FIG. 37.

FIG. 38 shows a top view of the conventional golf club head 1100 with the composite crown plate 1104 attached to a top portion of the main body 1102. As shown in FIG. 38, an interface or joint 1202 is formed between an outer peripheral edge of the crown plate 1104 and an inner peripheral edge of the cast opening 1110. As discussed above, it is desirable to have a top surface of the crown plate 1104 be as flush as possible with the top surface 1106 of the main body 1102 along the seam 1202 to avoid excessive grinding and the "ghosting" effect.

Figure 39:
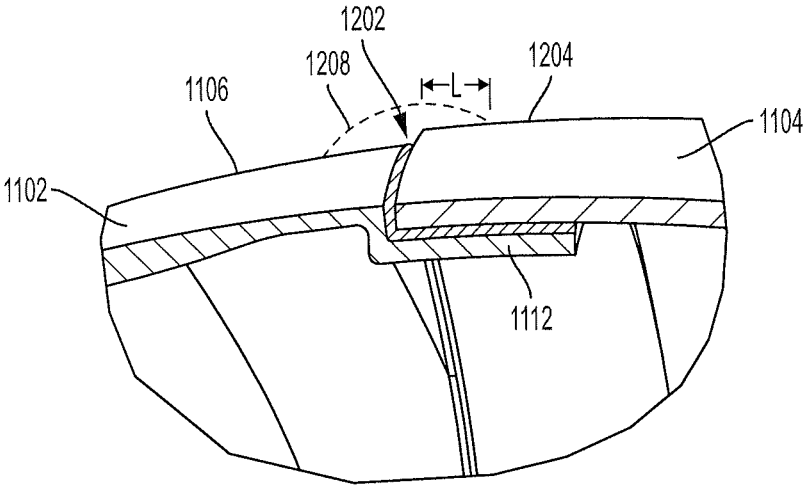
FIG. 39 illustrates an enlarged cross-sectional view taken along line A-A of FIG. 38 of the joint or interface between the main body and the crown plate of the conventional golf club head of FIG. 38.

FIG. 39 shows a cross-sectional view of the golf club head 1100 taken along line A-A of FIG. 38. The interface or joint 1202 is formed between adjacent edges of the main body 1102 and the crown plate 1104. As shown in FIG. 39, a bottom surface of the peripheral edge of the crown plate 1104 rests on top of a top surface of the flange 1112. Typically, an epoxy or other bonding agent or material is placed in the joint 1202 between adjoining surfaces and edges of the main body 1102, crown plate 1104 and the top surface of the flange 1112 to permanently affix the crown plate 1104 to the main body 1102 and flange 1112. As discussed above, however, due to varying thicknesses of the cast metal of the main body 1102 and the crown plate 1102, a top surface 1204 of the crown plate 1104 can be slightly higher (as shown in FIG. 29) or slightly lower than an adjacent top surface 1106 of the main body 1102 of the golf club head 1100. In other words, the top surface of the crown plate 1104 is not flush with the top surface 1106 of the main body 1102.

As discussed above, when the top surface 1204 of the crown plate 1104 is not flush with the top surface 1106 of the main body 1102, a number of problems can arise. Typically, one or both of the top surfaces 1204 and 1106 must be ground down to desired levels so that they become flush with one another. Such grinding takes additional time and resources and significantly impacts the production yield and costs when manufacturing a large number of golf club heads. Additionally, the grinding process mars or defaces the finish of the top surface 1204 and 1106 such that the marred portions of the top surface must be painted over to achieve a finished appearance. Thus, portions of the top surfaces 1204 and 1106 that are ground down must be concealed by paint, resulting in a smaller surface area of the natural finish of the respective surfaces 1204 and 1106 that remains visible to a user. This is undesirable for many types of materials such as carbon fiber, for example, which have an aesthetically pleasing surface appearance.

Alternative or additional techniques for achieving a flush fit or appearance at the joint 1202 include applying extra epoxy or bonding material (collectively referred to herein as "bonding material") in the seam of the joint 1202 such that an excess amount of bonding material, indicated by dashed line 1208, remains present above the joint 1202 after curing. Typically, the bonding material is cured at a predetermined temperature for a predetermined duration of time so that it becomes hardened. The bonding material can be any suitable bonding material such as 3M™ Scotch-Weld™ DP 420 epoxy, which comes in various colors. The excess bonding material 1208 can then be ground down using traditional grinding techniques and equipment to achieve a flat, smooth surface above the joint 1202. After grinding down the excess bonding material 208, at least the area that is ground down must be painted to achieve a finished appearance. Thus, as shown in FIG. 39, at least a distance "L" from the peripheral edge of the crown plate 1104 must be painted over resulting in a significant decrease in the amount of the finish of the crown plate (e.g., carbon fiber finish) remaining visible to a user. Additionally, as discussed above, even after painting over the joint, any unevenness between the underlying surfaces 1204 and 1106 may result in "ghosting" at the joint 1202, which is also aesthetically undesirable. As used herein, the term "flush" or "flush fit" refers to a condition when adjacent top surfaces, such as top surfaces 106 and 204 in FIG. 39, have a difference in height that is less than 0.05 millimeters (mm).

Figure 40:
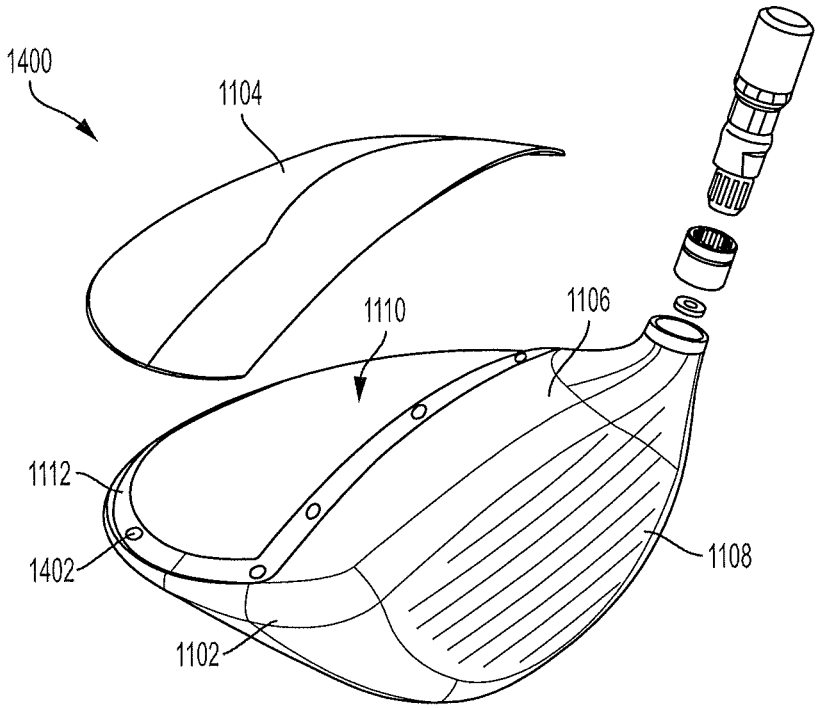
FIG. 40 illustrates an exploded perspective view of an exemplary golf club head including a plurality of compressible shims coupled between a main body and a crown plate of the golf club head, in accordance with one embodiment of the invention.

FIG. 40 illustrates a perspective, exploded view of a golf club head 1400, in which one or more compressible shims 1402 are interposed between a bottom surface of the crown plate 1104 and the top surface of the flange 1112, in accordance with one embodiment of the invention. By interposing the compressible shims 1402 between the crown plate 1104 and the flange 1112, the height of adjoining top surfaces 1204 and 1106 of the crown plate 1104 and the main body 1102, respectively, may be readily adjusted so they are flush with one another. Consequently, additional manufacturing steps (e.g., grinding down excess materials) may be eliminated or minimized. Additionally, since grinding down of excess material is eliminated or minimized by using the compressible shims 1402, a greater portion of the upper surface of the crown plate 1402 may be exposed.

As shown in FIG. 40, the golf club head 1400 is similar to the golf club head 1100 of FIG. 37, except that the club head 1400 further includes a plurality of compressible shims 1402 disposed on the top surface of the flange 1112. In some embodiments, each compressible shim 1402 is spaced from one another with a desired spacing, as described in further detail below. Preferably, each compressible shim 1412 is an elastically compressible material that can be compressed down to less than 10% of its original uncompressed thickness, more preferably down to less than 25% of its original uncompressed thickness, even more preferably down to less than 50% of its original uncompressed thickness, and most preferably down to less than 90% of its original uncompressed thickness while being able to rebound substantially to its uncompressed thickness upon removal of a compression force. In some embodiments, each compressible shim 1412 can be compressed down to less than 50% of its original uncompressed thickness when a compression force is applied and rebound to more than 90% of its original uncompressed thickness upon removal of the compression force.

The following table provides examples A-I showing an example initial uncompressed shim height, a final compressed shim height, the delta between the uncompressed and compressed shim heights, and the percent the shim was compressed. In this example, an uncompressed height of 1.5 mm is used, however this is purely an example and several other heights could be used ranging from about 0.8 mm to about 2.0 mm depending on the application.

TABLE 3

| Example | Uncompressed Height (mm) | Compressed Height (mm) | Delta (mm) | Percent Change |
|---|---|---|---|---|
| A | 1.5 | 0.15 | 1.35 | −90% |
| B | 1.5 | 0.3 | 1.2 | −80% |
| C | 1.5 | 0.45 | 1.05 | −70% |
| D | 1.5 | 0.6 | 0.9 | −60% |
| E | 1.5 | 0.75 | 0.75 | −50% |
| F | 1.5 | 0.9 | 0.6 | −40% |
| G | 1.5 | 1.05 | 0.45 | −30% |
| H | 1.5 | 1.2 | 0.3 | −20% |
| I | 1.5 | 1.35 | 0.15 | −10% |

The percent the shim is compressed is calculated by subtracting the initial uncompressed shim thickness from the final compressed shim thickness, dividing the result by the initial uncompressed shim thickness, and finally multiplying by 100 percent. See equation (3) below for further clarification. The equation yields a negative percent change because the shim is being compressed i.e. the final thickness is less than the uncompressed shim thickness.

$$\text{Percent Change}=100\%*(T_{final}-T_{initial})/T_{initial} \quad (3)$$

Additionally or alternatively, the percent change could also be expressed as an absolute percent change along with the word compression or tension to indicate the sign. In tensions the sign is positive and in compression the sign is negative. For example, a shim that is compressed at least 10% is the same as a shim that has a percent change of at least −10%.

Various elastomeric or spring materials having desired compression and rebound characteristics may be utilized in accordance with the present invention such as, for example, polymer springs, a plate spring, or Belleville spring, etc. In one embodiment, each compressible shim 1402 is made from PORON® 4701-30 material manufactured by Rogers Corporation. As described in further detail below, the rebound characteristics of the compressible shims 1402 push the crown plate 1104 upwardly away from the flange 1112, while the compressibility of the shims 1402 allow the top surface of the crown plate 1104 to be pushed down and held at a desired level such that it is flush with the adjoining top surfaces of the main body 1102 while bonding material in the joint 1202 cures and hardens to permanently hold the crown plate 1104 and main body 1102 together in flush relationship with one another.

In some embodiments, each compressible shim 1402 may be shaped as a dot with a diameter of between about 1.5 millimeters (mm) to about 8 millimeters (mm), preferably about 2.0 mm to about 6 mm, and even more preferably about 2.5 mm to about 4 mm. In some embodiments, each compressible shim may have and a thickness of between about 0.8 mm to about 2.0 mm, preferably about 1.0 mm to about 1.8 mm, even more preferably about 1.2 mm to about 1.6 mm. In alternative embodiments, the compressible shim 1402 may be formed in any of a variety of shapes (e.g., a square, a rectangle, a triangle, a polygon, etc.) with particular lateral and vertical dimensions while remaining within the scope of the present disclosure. It is desirable to achieve an optimum amount of rebound and compressibility provided by the shims 1402 depending on one or more factors such as weight of the crown plate, forces applied to hold down the crown plate in a flush relationship with adjoining surfaces, duration of cure, etc. In some embodiments, any number of shims 1402 may be disposed on the top surface of the flange 1112. In some embodiments, a total of 3 to 20 shims 1402 may be disposed in spaced relationship to one another on the top surface of the flange 1112. Alternatively, the number of the compressible shims 1412 may be determined based on a predefined percentage of an "available area" of the top surface of the flange 1406. As used herein, "available area" refers to an area of the top surface of the flange that is available to be bonded to another component (e.g., a crown plate). For example, if an available area of the top surface of the flange is "A," an area possessed by the compressible shims (hereinafter "shim area") may range between 0.5%-50% of A, preferably 0.5%-25% of A, more preferably 0.5%-15% of A, even more preferably 0.5%-10% of A, most preferably 0.5%-5% of A.

Additionally, the number of compressible shims may be accordingly determined based on the size of the compressible shims and the shim area (e.g., 1%-50% of A). In alternative embodiments, a plurality of spaced compressible shims may be replaced by a single continuous compressible gasket 1402 having desired compression and rebound characteristics, as discussed above, and sized to have a total shim area that is within a desired percentage of the available area of the flange 1112. In one embodiment, the total shim area may be 80% or less of the available area. In further embodiments, the total shim area may be 50% or less of the available area.

Figure 41:
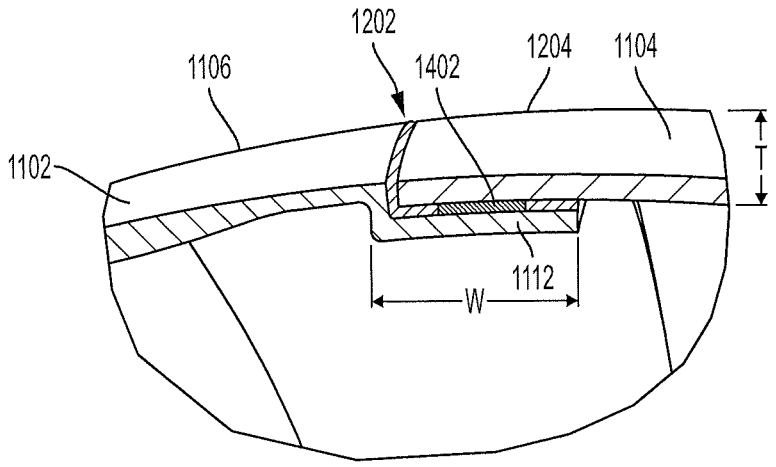
FIG. 41 illustrates an enlarged cross-sectional view of a joint between a main body of a golf club head and a crown plate having a compressible shim disposed within the joint, in accordance with one embodiment of the invention.

FIG. 41 illustrates an expanded cross-sectional view of the golf club head 1400 from the same perspective as shown in FIG. 39. Thus, FIG. 41 is similar to FIG. 39 except a compressible shim 1402 is disposed between a bottom surface of the crown plate 1104 and a top surface of the flange 1112 to provide desired rebound and compression characteristics, as discussed above. As further discussed above, in accordance with various embodiments, the total shim area covered by the one or more compressible shims 1402 is within a desired percentage of the available area of the top surface of the flange 1112. The available area of the flange 1112 is provided by the average circumference or length of the flange 1112 around the inner peripheral edge of the cast opening 1110 multiplied by the average width of the flange 1112, shown as width "W" in FIG. 41.

Typically, the flange 1112 is made from the same metal material (e.g., titanium alloy) as the main body 1102 and, therefore, can add significant mass to the golf club head 1400. In some embodiments, in order to control the mass contribution of the flange 1112 to the golf club head 1400, the width W can be adjusted to achieve a desired mass contribution. In some embodiments, if the flange 1112 adds too much mass to the golf club head 1400, it can take away from the decreased weight benefits of a crown plate 1104 made from a lighter composite material (e.g., carbon fiber or graphite). In some embodiments, the width of the flange 1112 may range from about 3 mm to about 8 mm, preferably from about 4 mm to about 7 mm, and more preferably from about 5.5 mm to about 6.5 mm. In some embodiments, the width of the flange is at least four times as wide as a thickness of the shell. In some embodiments, the thickness of the flange 1112 may range from about 0.4 mm to about 1 mm, preferably from about 0.5 mm to about 0.8 mm, and more preferably from about 0.6 mm to about 0.7 mm. In some embodiments, the depth of the flange 1112 may range from about 0.5 mm to about 1.75 mm, preferably from about 0.7 mm to about 1.2 mm, and more preferably from about 0.8 mm to about 1.1 mm. Although the flange 1112 may extend or run along the entire interface boundary between the crown plate 1104 and the main body 1102, in alternative embodiments, it can extend only partially along the interface boundary.

As further shown in FIG. 41, the crown plate 1104 has a desired thickness "T" that is designed to be slightly less than the difference in height between the top surface 1106 of the main body 1102 and the top surface of the flange 1112. The thickness of compressible shim 1402 is configured to push the top surface 1204 of the crown plate 1104 slightly above the height of the top surface 1106 while being sufficiently compressible to allow the top surface 1204 to be pushed down slightly below the height of the top surface 1106. The compressible shim 1402 further provides one or more spaces (i.e., areas unoccupied by the shims 1402) between the bottom surface of the crown plate 1104 and the top surface of the flange 1112 where bonding material may be applied or injected and thereafter allowed to cure to permanently affix the crown plate 1104 to the flange 1112.

It is appreciated that since the crown plate 1104 no longer has to be made extra thick to be ground down to be flush with the top surface 1106 of the main body 1102, the mass of the thinner crown plate 1104 is reduced, resulting in a reduction in overall mass of the club head 1400. In some embodiments, the thickness T of the crown plate 104 may range from 0.4 mm to 1.4 mm, preferably between about 0.85 mm and about 1.25 mm, even more preferably between about 0.60 mm and about 0.90 mm, and most preferably between about 0.50 mm and about 0.75 mm.

Figure 42:
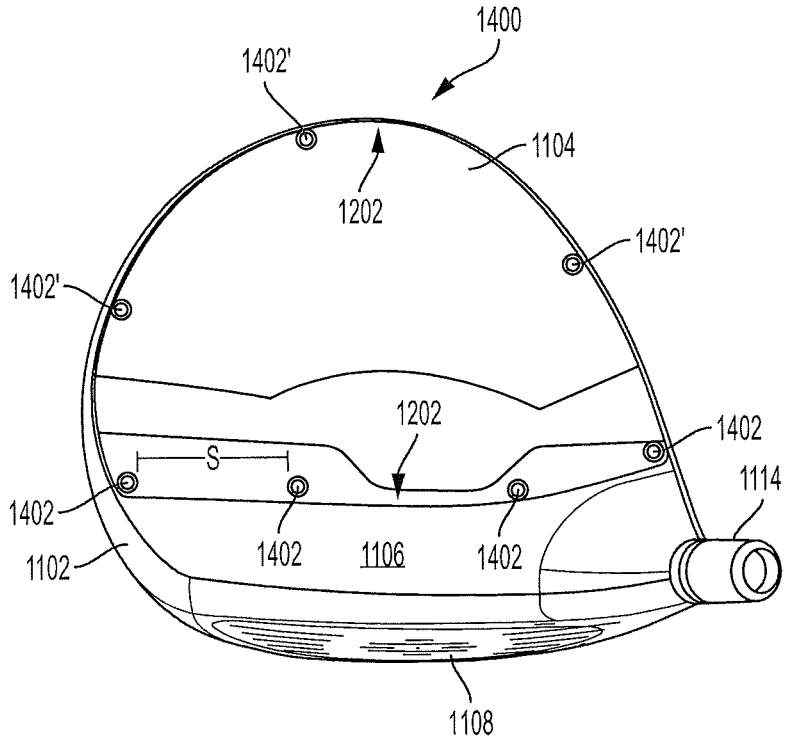
FIG. 42 illustrates a perspective top view of golf club head, in accordance with one embodiment of the invention.

FIG. 42 illustrates a perspective top view of the golf club head 1400, in accordance with one embodiment. For purposes of illustration only, the crown plate 1104 is shown as a transparent structure to illustrate exemplary locations and spacings of the compressible shims under the crown plate 1104 on top of the flange 1112 (not shown in FIG. 42). As shown in FIG. 42, in some embodiments, the golf club head 1400 may include seven (7) compressible shims 2402 having an average or minimum spacing "S" between adjacent compressible shims 2402. As discussed above, however, any number of compressible shims 2402 or, alternatively, any shim area as a percentage of available area of the flange 1212 may be provided to achieve desired rebound and compression characteristics of the shims 1402. Additionally, any spacing may be provided between adjacent shims to achieve such desired rebound and compression characteristics for a given application or club head design. For example, in some embodiments, the compressible shims 1402' located at a rear portion of the club head 1400 opposite the face 1108 may be eliminated, leaving only the four (4) remaining shims 1402 located closer to the face 1108.

Figure 43:
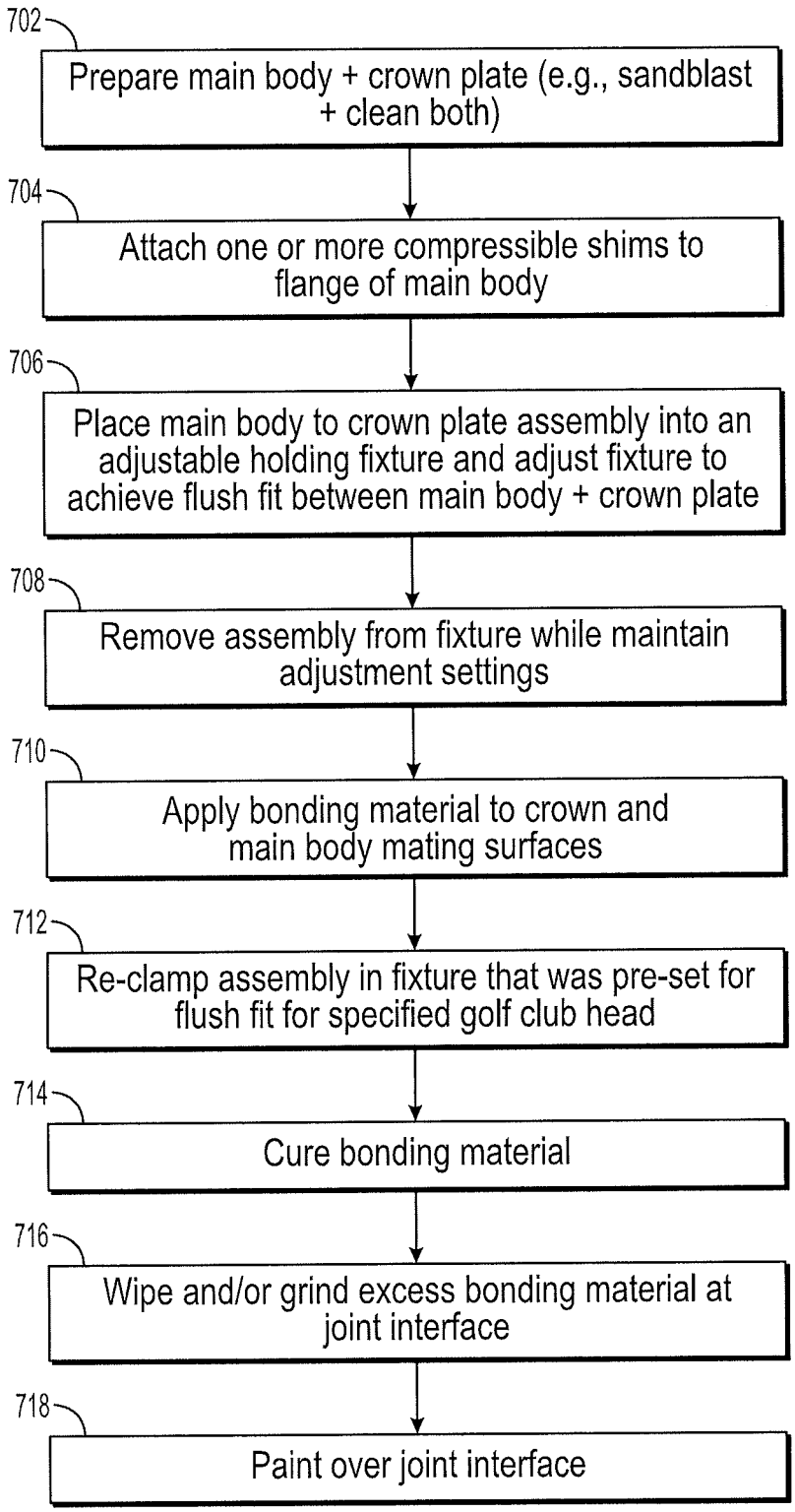
FIG. 43 illustrates an exemplary flow chart of a method to manufacture a golf club head including one or more compressible shims coupled between a crown plate and a main body of a golf club head.

FIG. 43 illustrates a process flow for manufacturing a golf club head 1400 utilizing one or more compressible shims 1402, as described above, in accordance with one exemplary embodiment. For clarity of discussion, the process steps of FIG. 43 are described in conjunction with the structures illustrated and described above with respect to FIGS. 29 and 30, in accordance with an exemplary embodiment. At step 702, the main body 1102 and the crown plate 1104 are provided and prepared for assembly. In one embodiment, both the main body 1102 and crown plate 1104 are sandblasted and cleaned to remove any undesired debris and/or surface imperfections. Although the crown plate 1104 is described in connection with the exemplary embodiments disclosed herein, in alternative embodiments, the invention can be applied to any cover plate configured to cover a cavity located on any portion of the golf club head in similar fashion. Next, at step 704, one or more compressible shims 1402 are attached (via glue or epoxy, for example) at desire locations to a top surface of the flange 1112 of the main body 1102.

Next, at step 706, the crown plate 1104 is placed on top of the shim 1402 within the cast opening 1110 of the main body 1102, and the resulting assembly is placed in an adjustable fixture for achieving a flush fit between the crown plate 1104 and main body 1102. In some embodiments, the adjustable fixture includes a plurality (e.g., seven) adjustable screws that apply point load pressure along corresponding predetermined peripheral areas of the crown plate 1104. Each of the adjustable screws are adjusted to compress a corresponding one or more of the compressible shims 1402 to achieve a flush fit between the top surface of the crown plate 1104 and adjacent adjoining top surfaces of the main body 1102. It is appreciated that since the top surface 1204 of the crown plate 1104 and the top surface 1106 of the main body 1102 may be each formed as a curved surface, different amounts of adjustment may be necessary at each adjustment point to achieve a flush surface across the entire joint 1202. Thus, the plurality of shims 1402 disposed over the flange 1112 may be individually tuned (i.e., compressed) to achieve a flush surface across the entire joint 1202.

Next, at step 708, the main body 1102 and crown plate 1104 assembly is removed from the fixture while maintaining the settings of the adjustable screws that achieved the flush fit. At step 710, a bonding material (e.g., Scotch-Weld™ DP 420 epoxy) is applied to mating surfaces of the main body 1102 and crown plate 1104, as described above. Next, at step 712, the assembly is re-inserted and re-clamped within the fixture that was pre-set to achieve a flush fit between the top surface of the crown plate 1104 and adjacent adjoining top surfaces of the main body 1102. While the assembly is clamped within the fixture in the flush-fit setting, at step 714, the bonding material is allowed to cure or dry, thereby permanently affixing the crown plate 1104 to the main body 1102, in the desired flush fit relationship. In one embodiment, the bonding material is allowed to cure at a temperature of 85 degrees Celsius for thirty minutes. After the bonding material is completely cured or dried, at step 716, the assembly is removed from the fixture and any excess bonding material is wiped or ground away, as necessary or desired. Finally, at step 718, the joint interface 1202 between the crown plate 1104 and main body 1102 is painted, as desired.

As described above, in some embodiments, the invention provides a method of manufacturing a golf club head having two or more rigid adjoining structures to easily render the top surfaces of the adjoining structures flush with one another, thereby achieving a cosmetically seamless joint or interface between the adjoining structures. Thus, the method eliminates or substantially reduces grinding away excess material from one or more of the adjoining structures, and/or bonding material, resulting in increased production yield and decreased production time and costs. As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C.

While various exemplary embodiments of the invention have been described above, it should be understood that they have been presented by way of example only, and not by way of limitation. For example, it should be understood that the various features and functionalities described in connection with one or more individual embodiments are not limited in their applicability to the particular embodiment(s) with which they are described, but instead can be applied, alone or in some combination, with one or more other embodiments of the invention described herein, whether or not such combination of features are explicitly described as being a part of a described embodiment. Thus the breadth and scope of the present invention should not be limited by any of the above-described exemplary embodiments.

Likewise, the various figures or diagrams depict exemplary configurations of the invention, which are provided to illustrate various features and functionalities that can be provided by various embodiments of the invention. The invention is not restricted to the illustrated example architectures or configurations, but can be implemented using a variety of alternative architectures and configurations. For example, although the exemplary embodiments disclosed herein are directed to a "driver" type of golf club head, principles of the present invention may be applied to any type of golf club head (e.g., fairway woods, hybrid wood-iron, irons, putters) having two or more rigid adjoining surfaces that are intended to be flush with one another, while remaining within the scope of the present disclosure. In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims and their equivalents.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club head, comprising:

a main body comprising a face portion, a top portion, a bottom portion opposite the top portion, a toe portion, a heel portion opposite the toe portion, and a body interior surface defining an interior cavity;

a first weight track located on the bottom portion and configured to receive a first weight having a first mass, wherein the first weight is slidably adjustable within the first weight track so as to adjust a center of gravity (CG) of the golf club head; and a second weight track located on the bottom portion and configured to receive a second weight having a second mass different from the first mass, wherein the second weight is slidably adjustable within the second weight track so as to adjust the CG of the golf club head, and wherein the first and second weights are configured to be interchangeable with one another so that each weight may be slidably adjusted and secured within either the first or second weight tracks, respectively, wherein the first weight track has a first weight track interior surface that partially defines the interior cavity of the body;

wherein the first weight comprises an outer weight member having a through bore, an inner weight member having a threaded aperture, and a threaded fastener having a head and a shaft extending from the head, wherein the shaft of the threaded fastener is configured to pass through the through bore of the outer weight member and thread into the threaded opening of the inner weight member such that tightening the threaded fastener causes the first weight to clamp at least a portion of the first weight track;

wherein the outer weight member is non-circular and at least one of the threaded fastener and the outer weight member are at least partially uncovered;

wherein the first weight track and the second weight track are permanently secured to the body;

wherein the golf club head has an Ixx (moment of inertia about a CG x-axis) and Izz (moment of inertia about a CG z-axis) such that when the first and second weights are located in a first configuration the combined Ixx and Izz is at least 673 $kg \cdot mm^2$, wherein the first and second weights may be located in a second configuration by slidably moving at least one of the first and second weights in at least one of the first and second weight tracks such that the combined Ixx and Izz is at least 724 $kg \cdot mm^2$ and the Ixx and Izz differ by at least 22 $kg \cdot Mm^2$.

2. The golf club head of claim 1, wherein at least a portion of the second weight, when secured within the second weight track, extends beyond a surface of the bottom portion so as to lower the CG of the golf club head in a direction away from the top portion.

3. The golf club head of claim 1, wherein:

the top portion comprises a crown opening and crown insert secured to the top portion so as to cover the crown opening; and the bottom portion comprises a sole opening and sole insert secured to the bottom portion so as to cover the sole opening, wherein the second weight track is located on the sole insert.

4. The golf club head of claim 3 wherein the sole and crown inserts are made of a composite material and remaining portions of the main body are made of a material selected from a group consisting of: titanium, a titanium alloy, aluminum, an aluminum alloy, steel and a steel alloy.

5. The golf club head of claim 3 wherein the first weight track is located on the bottom portion between the face portion and the sole opening.

6. The golf club head of claim 1 further comprising an adjustable head-shaft connection assembly comprising a sleeve secured by a fastening member in a locked position, the head-shaft connection system configured to allow the golf club head to be adjustably attachable to a golf club shaft in a plurality of different positions resulting in different combinations of loft angle, face angle, or lie angle.

7. The golf club head of claim 1 wherein the main body comprises a frame made of a metal material, wherein the face portion comprises a face plate coupled to the frame, the top portion comprises a crown insert coupled to the frame, and the bottom portion comprises a sole insert coupled to the frame, wherein the crown insert and sole insert are made from one or more materials different from the metal material.

8. The golf club head of claim 1, wherein the top portion comprises a crown opening, the crown opening configured to receive a composite crown insert, and wherein the bottom portion comprises a toe-side sole opening and a heel-side sole opening, wherein the toe-side sole opening is positioned toe-ward of the first and second weight tracks and configured to receive a toe-side composite sole insert and the toe-side composite sole insert covers the toe-side sole opening, wherein the heel-side sole opening is positioned heel-ward of the first and second weight tracks and configured to receive a heel-side composite sole insert and the heel-side composite sole insert covers the a heel-side sole opening.

9. The golf club head of claim 8, wherein the first and second weight tracks each comprise a ledge for receiving the first and second weights.

10. The golf club head of claim 9, further comprising at least one internal rib extending outwardly from an internal surface of the second weight track to provide structural support and increased rigidity to the golf club head.

11. The golf club head of claim 1, further comprising at least one internal rib extending outwardly from an internal surface of the second weight track to provide structural support and increased rigidity to the golf club head, wherein the top portion comprises a crown opening, the crown opening configured to receive a composite crown insert, and wherein the first and second weight tracks each comprise a ledge for receiving the first and second weights.

12. The golf club head of claim 1, wherein the top portion comprises a crown opening, the crown opening configured to receive a composite crown insert thereby enclosing the crown opening.

13. The golf club head of claim 12, wherein the bottom portion comprises a sole opening, the sole opening configured to receive a composite sole insert thereby enclosing the sole opening.

14. The golf club head of claim 13, wherein the sole insert comprises at least 25% of a sole surface area of the club head, and the crown insert comprises at least 50% of a crown surface area of the club head.

15. The golf club head of claim 1, wherein at least a portion of the face portion is formed from a composite material.

16. The golf club head of claim 1, further comprising one or more weight ports integrally formed with the main body.

17. The golf club head of claim 1, further comprising one or more overhang portions that extend over at least a portion of at least one of the first weight track and the second weight track.

18. The golf club head of claim 17, wherein the one or more overhang portions are integrally formed with the main body.

19. The golf club head of claim 1, wherein the second weight track extends substantially in a fore-to-aft direction and at least one fore-to-aft rib extends along a top interior surface of the second weight track.

20. The golf club head of claim 1, further comprising a hosel located proximate the heel portion of the golf club head and a hosel rib extending along an interior surface of the golf club head joining an interior portion of the hosel to an interior portion of at least one of the first weight track and the second weight track.

* * * * *